US008362424B2

(12) United States Patent
Brown et al.

(10) Patent No.: US 8,362,424 B2
(45) Date of Patent: Jan. 29, 2013

(54) MASS SPECTROMETER

(75) Inventors: Jeffery Mark Brown, Cheshire (GB); Martin Raymond Green, Cheshire (GB)

(73) Assignee: Micromass UK Limited, Manchester (GB)

( * ) Notice: Subject to any disclaimer, the term of this patent is extended or adjusted under 35 U.S.C. 154(b) by 235 days.

(21) Appl. No.: 12/744,384

(22) PCT Filed: Nov. 24, 2008

(86) PCT No.: PCT/GB2008/003916

§ 371 (c)(1),
(2), (4) Date: Aug. 17, 2010

(87) PCT Pub. No.: WO2009/066087

PCT Pub. Date: May 28, 2009

(65) Prior Publication Data

US 2011/0024618 A1 Feb. 3, 2011

Related U.S. Application Data

(60) Provisional application No. 61/014,085, filed on Dec. 17, 2007.

(30) Foreign Application Priority Data

Nov. 23, 2007 (GB) ..... 0723183.0

(51) Int. Cl.
*H01J 49/40* (2006.01)

(52) U.S. Cl. ..... 250/292; 250/290; 250/281; 250/282

(58) Field of Classification Search ..... 250/292, 250/290, 285, 281, 282
See application file for complete search history.

(56) References Cited

U.S. PATENT DOCUMENTS

| | | | | |
|---|---|---|---|---|
| 6,791,078 | B2 * | 9/2004 | Giles et al. | 250/286 |
| 6,800,846 | B2 | 10/2004 | Bateman et al. | |
| 6,838,662 | B2 * | 1/2005 | Bateman et al. | 250/286 |
| 6,891,157 | B2 | 5/2005 | Bateman et al. | |
| 7,196,326 | B2 * | 3/2007 | Franzen et al. | 250/288 |
| 7,495,213 | B2 * | 2/2009 | Loboda | 250/292 |
| 7,534,622 | B2 * | 5/2009 | Hunt et al. | 436/173 |
| 8,164,052 | B2 * | 4/2012 | Green et al. | 250/281 |
| 2009/0173877 | A1 | 7/2009 | Bateman et al. | |
| 2010/0065733 | A1 | 3/2010 | Bateman et al. | |
| 2010/0108878 | A1 | 5/2010 | Bateman et al. | |
| 2010/0294923 | A1 | 11/2010 | Kenny et al. | |

OTHER PUBLICATIONS

Tung, Journal of Applied Physics, American Institute of Physics. New York, US, vol. 80, Nr:7, pp. 3646-3655, 1996.

* cited by examiner

*Primary Examiner* — Kiet T Nguyen
(74) *Attorney, Agent, or Firm* — Diederiks & Whitelaw, PLC

(57) ABSTRACT

An ion-ion reaction cell is provided comprising a plurality of electrodes forming an ion guide. A transient DC voltage wave is applied to the electrodes in order to load reagent anions into the ion guide. Analyte cations are then subsequently transmitted through the ion-ion reaction cell by a subsequent transient DC voltage wave. Ion are arranged to undergo ion-ion reactions within the reaction cell and the resulting fragment ions which are formed within the reaction cell are then subsequently translated out of the reaction cell by means of a transient DC voltage wave.

19 Claims, 10 Drawing Sheets

MASS SPECTROMETER

CROSS REFERENCE TO RELATED APPLICATIONS

This application is the National Stage of International Application No. PCT/GB2008/003916, filed Nov. 24, 2008, which claims priority to and benefit of United Kingdom Patent Application No. 0723183.0, filed Nov. 23, 2007, and U.S. Provisional Patent Application Ser. No. 61/014,085, filed Dec. 17, 2007. The entire contents of these applications are incorporated herein by reference.

BACKGROUND OF THE INVENTION

The present invention relates to an ion-ion reaction or fragmentation device and a method of performing ion-ion reactions or fragmentation. The present invention also relates to an Electron Transfer Dissociation and/or Proton Transfer Reaction device. Analyte ions may be fragmented either by ion-ion reactions or by ion-neutral gas reactions. Analyte ions and/or fragment ions may also be charge reduced by Proton Transfer Reaction.

Electrospray ionisation ion sources are well known and may be used to convert neutral peptides eluting from an HPLC column into gas-phase analyte ions. In an aqueous acidic solution, tryptic peptides will be ionised on both the amino terminus and the side chain of the C-terminal amino acid. As the peptide ions proceed to enter a mass spectrometer the positively charged amino groups hydrogen bond and transfer protons to the amide groups along the backbone of the peptide.

It is known to fragment peptide ions by increasing the internal energy of the peptide ions through collisions with a collision gas. The internal energy of the peptide ions is increased until the internal energy exceeds the activation energy necessary to cleave the amide linkages along the backbone of the molecule. This process of fragmenting ions by collisions with a neutral collision gas is commonly referred to as Collision Induced Dissociation ("CID"). The fragment ions which result from Collision Induced Dissociation are commonly referred to as b-type and y-type fragment or product ions, wherein b-type fragment ions contain the amino terminus plus one or more amino acid residues and y-type fragment ions contain the carboxyl terminus plus one or more amino acid residues.

Other methods of fragmenting peptides are known. An alternative method of fragmenting peptide ions is to interact the peptide ions with thermal electrons by a process known as Electron Capture Dissociation ("ECD"). Electron Capture Dissociation cleaves the peptide in a substantially different manner to the fragmentation process which is observed with Collision Induced Dissociation. In particular, Electron Capture Dissociation cleaves the backbone N—$C_\alpha$ bond or the amine bond and the resulting fragment ions which are produced are commonly referred to as c-type and z-type fragment or product ions. Electron Capture Dissociation is believed to be non-ergodic i.e. cleavage occurs before the transferred energy is distributed over the entire molecule. Electron Capture Dissociation also occurs with a lesser dependence on the nature of the neighbouring amino acid and only the N-side of proline is 100% resistive to Electron Capture Dissociation cleavage.

One advantage of fragmenting peptide ions by Electron Capture Dissociation rather than by Collision Induced Dissociation is that Collision Induced Dissociation suffers from a propensity to cleave Post Translational Modifications ("PTMs") making it difficult to identify the site of modification. By contrast, fragmenting peptide ions by Electron Capture Dissociation tends to preserve Post Translational Modifications arising from, for example, phosphorylation and glycosylation.

However, the technique of Electron Capture Dissociation suffers from the significant problem that it is necessary simultaneously to confine both positive ions and electrons at near thermal kinetic energies. Electron Capture Dissociation has been demonstrated using Fourier Transform Ion Cyclotron Resonance ("FT-ICR") mass analysers which use a superconducting magnet to generate large magnetic fields. However, such mass spectrometers are very large and are prohibitively expensive for the majority of mass spectrometry users.

As an alternative to Electron Capture Dissociation it has been demonstrated that it is possible to fragment peptide ions by reacting negatively charged reagent ions with multiply charged analyte cations in a linear ion trap. The process of reacting positively charged analyte ions with negatively charged reagent ions has been referred to as Electron Transfer Dissociation ("ETD"). Electron Transfer Dissociation is a mechanism wherein electrons are transferred from negatively charged reagent ions to positively charged analyte ions. After electron transfer, the charge-reduced peptide or analyte ion dissociates through the same mechanisms which are believed to be responsible for fragmentation by Electron Capture Dissociation i.e. it is believed that Electron Transfer Dissociation cleaves the amine bond in a similar manner to Electron Capture Dissociation. As a result, the product or fragment ions which are produced by Electron Transfer Dissociation of peptide analyte ions comprise mostly c-type and z-type fragment or product ions.

One particular advantage of Electron Transfer Dissociation is that such a process is particularly suited for the identification of post-translational modifications (PTMs) since weakly bonded PTMs like phosphorylation or glycosylation will survive the electron induced fragmentation of the backbone of the amino acid chain.

At present Electron Transfer Dissociation has been demonstrated by mutually confining cations and anions in a 2D linear ion trap which is arranged to promote ion-ion reactions between reagent anions and analyte cations. The cations and anions are simultaneously trapped within the 2D linear ion trap by applying an auxiliary axially confining RF pseudo-potential barrier at both ends of the 2D linear quadrupole ion trap. However, this approach is problematic since the effective RF pseudo-potential barrier height observed by an ion within the ion trap will be a function of the mass to charge ratio of the ion. As a result, the mass to charge ratio range of analyte and reagent ions which can be confined simultaneously within the ion trap in order to promote ion-ion reactions is somewhat limited.

Another method of performing Electron Transfer Dissociation is known wherein a fixed DC axial potential is applied at both ends of a 2D linear quadrupole ion trap in order to confine ions having a certain polarity (e.g. reagent anions) within the ion trap. Ions having an opposite polarity (e.g. analyte cations) to those confined within the ion trap are then directed into the ion trap. The analyte cations will react with the reagent anions already confined within the ion trap. However, the axial DC barriers which are used to retain the reagent anions within the ion trap will also have an opposite effect of acting as an accelerating potential to the analyte cations which are introduced into the ion trap. As a result, there will be a large kinetic energy difference or mismatch between the reagent anions and the analyte cations such that any ion-ion reactions which may occur will occur in a sub-optimal manner.

It is desired to provide an improved method of and apparatus for performing ion-ion reactions and ion-neutral gas reactions and in particular to provide an improved method of and apparatus for optimising the Electron Transfer Dissociation ("ETD") fragmentation process and/or Proton Transfer Reaction charge state reduction process of analyte and fragment ions such as peptides.

SUMMARY OF THE INVENTION

According to an aspect of the present invention there is provided an Electron Transfer Dissociation or Proton Transfer Reaction device comprising an ion guide comprising a plurality of electrodes having at least one aperture, wherein ions are transmitted in use through the apertures.

A first device is preferably arranged and adapted to apply one or more first transient DC voltages or potentials or one or more first transient DC voltage or potential waveforms to at least some of the plurality of electrodes in order to drive or urge at least some first ions along and/or through at least a portion of the axial length of the ion guide in a first direction.

The first ions are preferably caused to remain within the ion guide.

According to an embodiment the first device is preferably arranged and adapted to apply the one or more first transient DC voltages or potentials or the one or more first transient DC voltage or potential waveforms to 0-5%, 5-10%, 10-15%, 15-20%, 20-25%, 25-30%, 30-35%, 35-40%, 40-45%, 45-50%, 50-55%, 55-60%, 60-65%, 65-70%, 70-75%, 75-80%, 80-85%, 85-90%, 90-95% or 95-100% of the plurality of electrodes in order to drive or urge at least some the first ions along and/or through at least 0-5%, 5-10%, 10-15%, 15-20%, 20-25%, 25-30%, 30-35%, 35-40%, 40-45%, 45-50%, 50-55%, 55-60%, 60-65%, 65-70%, 70-75%, 75-80%, 80-85%, 85-90%, 90-95% or 95-100% of the axial length of the ion guide.

The first ions are preferably caused to react with second ions and/or neutral gas or vapour already present within the ion guide. Alternatively, the first ions may be caused to react with second ions and/or neutral gas or vapour which is subsequently added to or provided into the ion guide.

The Electron Transfer Dissociation or Proton Transfer Reaction device may further comprise a device arranged and adapted to progressively increase, progressively decrease, progressively vary, scan, linearly increase, linearly decrease, increase in a stepped, progressive or other manner or decrease in a stepped, progressive or other manner the amplitude, height or depth of the one or more first transient DC voltages or potentials or the one or more first transient DC voltage or potential waveforms by $x_3$ Volts over a time period $t_3$.

According to an embodiment $x_3$ is preferably selected from the group consisting of: (i) <0.1 V; (ii) 0.1-0.2 V; (iii) 0.2-0.3 V; (iv) 0.3-0.4 V; (v) 0.4-0.5 V; (vi) 0.5-0.6 V; (vii) 0.6-0.7 V; (viii) 0.7-0.8 V; (ix) 0.8-0.9 V; (x) 0.9-1.0 V; (xi) 1.0-1.5 V; (xii) 1.5-2.0 V; (xiii) 2.0-2.5 V; (xiv) 2.5-3.0 V; (xv) 3.0-3.5 V; (xvi) 3.5-4.0 V; (xvii) 4.0-4.5 V; (xviii) 4.5-5.0 V; (xix) 5.0-5.5 V; (xx) 5.5-6.0 V; (xxi) 6.0-6.5 V; (xxii) 6.5-7.0 V; (xxiii) 7.0-7.5 V; (xxiv) 7.5-8.0 V; (xxv) 8.0-8.5 V; (xxvi) 8.5-9.0 V; (xxvii) 9.0-9.5 V; (xxviii) 9.5-10.0 V; and (xxix) >10.0 V.

According to an embodiment $t_3$ is preferably selected from the group consisting of: (i) <1 ms; (ii) 1-10 ms; (iii) 10-20 ms (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

The first device is preferably arranged and adapted to progressively increase, progressively decrease, progressively vary, linearly increase, linearly decrease, increase in a stepped, progressive or other manner or decrease in a stepped, progressive or other manner the amplitude, height or depth of the one or more first transient DC voltages or potentials or the one or more first transient DC voltage or potential waveforms applied to the plurality of electrodes as a function of position or displacement along the length of the ion guide.

The first device may be arranged and adapted to reduce the amplitude, height or depth of the one or more first transient DC voltages or potentials or the one or more first transient DC voltage or potential waveforms applied to the plurality of electrodes along the length of the ion guide from a first end of the ion guide to a central or other region of the ion guide.

According to an embodiment the amplitude, height or depth of the one or more first transient DC voltages or potentials or the one or more first transient DC voltage or potential waveforms applied to the plurality of electrodes at a first position along the length of the ion guide may be X. The amplitude, height or depth of the one or more first transient DC voltages or potentials or the one or more first transient DC voltage or potential waveforms applied to the plurality of electrodes at a second different position along the length of the ion guide may be arranged to be 0-0.05 X, 0.05-0.10 X, 0.10-0.15 X, 0.15-0.20 X, 0.20-0.25 X, 0.25-0.30 X, 0.30-0.35 X, 0.35-0.40 X, 0.40-0.45 X, 0.45-0.50 X, 0.50-0.55 X, 0.55-0.60 X, 0.60-0.65 X, 0.65-0.70 X, 0.70-0.75 X, 0.75-0.80 X, 0.80-0.85 X, 0.85-0.90 X, 0.90-0.95 X or 0.95-1.00 X.

According to an embodiment the amplitude, height or depth of the one or more first transient DC voltages or potentials or the one or more first transient DC voltage or potential waveforms applied to the plurality of electrodes may be arranged to reduce to zero or near zero along at least 1%, 5%, 10%, 20%, 30%, 40%, 50%, 60%, 70%, 80%, 90% or 95% of the axial length of the ion guide so that the first ions are no longer confined axially by one or more DC potential barriers.

The Electron Transfer Dissociation or Proton Transfer Reaction device preferably further comprises a device arranged and adapted to progressively increase, progressively decrease, progressively vary, scan, linearly increase, linearly decrease, increase in a stepped, progressive or other manner or decrease in a stepped, progressive or other manner the velocity or rate at which the one or more first transient DC voltages or potentials or the one or more first transient DC voltage or potential waveforms are applied to or translated along the electrodes by $x_4$ m/s over a time period $t_4$.

According to an embodiment $x_4$ is preferably selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10; (xi) 10-11; (xii) 11-12; (xiii) 12-13; (xiv) 13-14; (xv) 14-15; (xvi) 15-16; (xvii) 16-17; (xviii) 17-18; (xix) 18-19; (xx) 19-20; (xxi) 20-30; (xxii) 30-40; (xxiii) 40-50; (xxiv) 50-60; (xxv) 60-70; (xxvi) 70-80; (xxvii) 80-90; (xxviii) 90-100; (xxix) 100-150; (xxx) 150-200; (xxxi) 200-250; (xxxii) 250-300; (xxxiii) 300-350; (xxxiv) 350-400; (xxxv) 400-450; (xxxvi) 450-500; (xxxvii) 500-600; (xxxviii) 600-700; (xxxix) 700-800; (xl) 800-900; (xli) 900-1000; (xlii) 1000-2000; (xliii) 2000-3000; (xliv) 3000-4000; (xlv) 4000-5000; (xlvi) 5000-6000; (xlvii) 6000-7000; (xlviii) 7000-8000; (xlix) 8000-9000; (l) 9000-10000; and (li) >10000.

According to an embodiment $t_4$ is preferably selected from the group consisting of: (i) <1 ms; (ii) 1-10 ms; (iii) 10-20 ms;

(iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

The first device is preferably also arranged and adapted to apply one or more second transient DC voltages or potentials or one or more second transient DC voltage or potential waveforms to at least some of the plurality of electrodes in order to drive or urge at least some second ions along and/or through at least a portion of the axial length of the ion guide in a second direction wherein the second direction is either substantially the same or substantially different to the first direction. According to the preferred embodiment the one or more second transient DC voltages or potentials are preferably applied to the electrodes of the device subsequent to the application of the one or more first transient DC voltages or potentials to the electrodes.

The first device is preferably arranged and adapted to apply the one or more second transient DC voltages or potentials or the one or more second transient DC voltage or potential waveforms to 0-5%, 5-10%, 10-15%, 15-20%, 20-25%, 25-30%, 30-35%, 35-40%, 40-45%, 45-50%, 50-55%, 55-60%, 60-65%, 65-70%, 70-75%, 75-80%, 80-85%, 85-90%, 90-95% or 95-100% of the plurality of electrodes in order to drive or urge at least some the second ions along and/or through at least 0-5%, 5-10%, 10-15%, 15-20%, 20-25%, 25-30%, 30-35%, 35-40%, 40-45%, 45-50%, 50-55%, 55-60%, 60-65%, 65-70%, 70-75%, 75-80%, 80-85%, 85-90%, 90-95% or 95-100% of the axial length of the ion guide.

The Electron Transfer Dissociation or Proton Transfer Reaction device preferably further comprises a device which is arranged and adapted to progressively increase, progressively decrease, progressively vary, scan, linearly increase, linearly decrease, increase in a stepped, progressive or other manner or decrease in a stepped, progressive or other manner the amplitude, height or depth of the one or more second transient DC voltages or potentials or the one or more second transient DC voltage or potential waveforms by $x_5$ Volts over a time period $t_5$.

According to an embodiment $x_5$ is preferably selected from the group consisting of: (i) <0.1 V; (ii) 0.1-0.2 V; (iii) 0.2-0.3 V; (iv) 0.3-0.4 V; (v) 0.4-0.5 V; (vi) 0.5-0.6 V; (vii) 0.6-0.7 V; (viii) 0.7-0.8 V; (ix) 0.8-0.9 V; (x) 0.9-1.0 V; (xi) 1.0-1.5 V; (xii) 1.5-2.0 V; (xiii) 2.0-2.5 V; (xiv) 2.5-3.0 V; (xv) 3.0-3.5 V; (xvi) 3.5-4.0 V; (xvii) 4.0-4.5 V; (xviii) 4.5-5.0 V; (xix) 5.0-5.5 V; (xx) 5.5-6.0 V; (xxi) 6.0-6.5 V; (xxii) 6.5-7.0 V; (xxiii) 7.0-7.5 V; (xxiv) 7.5-8.0 V; (xxv) 8.0-8.5 V; (xxvi) 8.5-9.0 V; (xxvii) 9.0-9.5 V; (xxviii) 9.5-10.0 V; and (xxix) >10.0 V.

According to an embodiment $t_5$ is preferably selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

The first device is preferably arranged and adapted to progressively increase, progressively decrease, progressively vary, linearly increase, linearly decrease, increase in a stepped, progressive or other manner or decrease in a stepped, progressive or other manner the amplitude, height or depth of the one or more second transient DC voltages or potentials or the one or more second transient DC voltage or potential waveforms applied to the plurality of electrodes as a function of position or displacement along the length of the ion guide.

The first device is preferably arranged and adapted to reduce the amplitude, height or depth of the one or more second transient DC voltages or potentials or the one or more second transient DC voltage or potential waveforms applied to the plurality of electrodes along the length of the ion guide from a second end of the ion guide to a central or other region of the ion guide.

According to an embodiment the amplitude, height or depth of the one or more second transient DC voltages or potentials or the one or more second transient DC voltage or potential waveforms applied to the plurality of electrodes at a second position along the length of the ion guide may be X. The amplitude, height or depth of the one or more second transient DC voltages or potentials or the one or more second transient DC voltage or potential waveforms applied to the plurality of electrodes at a second different position along the length of the ion guide may be arranged to be 0-0.05 X, 0.05-0.10 X, 0.10-0.15 X, 0.15-0.20 X, 0.20-0.25 X, 0.25-0.30 X, 0.30-0.35 X, 0.35-0.40 X, 0.40-0.45 X, 0.45-0.50 X, 0.50-0.55 X, 0.55-0.60 X, 0.60-0.65 X, 0.65-0.70 X, 0.70-0.75 X, 0.75-0.80 X, 0.80-0.85 X, 0.85-0.90 X, 0.90-0.95 X or 0.95-1.00 X.

According to an embodiment the amplitude, height or depth of the one or more second transient DC voltages or potentials or the one or more second transient DC voltage or potential waveforms applied to the plurality of electrodes may be arranged to reduce to zero or near zero along at least 1%, 5%, 10%, 20%, 30%, 40%, 50%, 60%, 70%, 80%, 90% or 95% of the axial length of the ion guide so that the second ions are no longer contained axially by one or more potential barriers.

The Electron Transfer Dissociation or Proton Transfer Reaction device preferably further comprises a device arranged and adapted to progressively increase, progressively decrease, progressively vary, scan, linearly increase, linearly decrease, increase in a stepped, progressive or other manner or decrease in a stepped, progressive or other manner the velocity or rate at which the one or more second transient DC voltages or potentials or the one or more second transient DC voltage or potential waveforms are applied to or translated along the electrodes by $x_6$ m/s over a time period $t_6$.

According to an embodiment $x_6$ is preferably selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10; (xi) 10-11; (xii) 11-12; (xiii) 12-13; (xiv) 13-14; (xv) 14-15; (xvi) 15-16; (xvii) 16-17; (xviii) 17-18; (xix) 18-19; (xx) 19-20; (xxi) 20-30; (xxii) 30-40; (xxiii) 40-50; (xxiv) 50-60; (xxv) 60-70; (xxvi) 70-80; (xxvii) 80-90; (xxviii) 90-100; (xxix) 100-150; (xxx) 150-200; (xxxi) 200-250; (xxxii) 250-300; (xxxiii) 300-350; (xxxiv) 350-400; (xxxv) 400-450; (xxxvi) 450-500; (xxxvii) 500-600; (xxxviii) 600-700; (xxxix) 700-800; (xl) 800-900; (xli) 900-1000; (xlii) 1000-2000; (xliii) 2000-3000; (xliv) 3000-4000; (xlv) 4000-5000; (xlvi) 5000-6000; (xlvii) 6000-7000; (xlviii) 7000-8000; (xlix) 8000-9000; (l) 9000-10000; and (li) >10000.

According to an embodiment $t_6$ is preferably selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

The first ions preferably comprise either: (i) anions or negatively charged ions; (ii) cations or positively charged ions; or (iii) a combination or mixture of anions and cations.

The second ions preferably comprise either: (i) anions or negatively charged ions; (ii) cations or positively charged ions; or (iii) a combination or mixture of anions and cations.

Embodiments are contemplated wherein different species of cations and/or reagent ions are input into the reaction device from opposite ends of the device.

According to an embodiment the first ions preferably have a first polarity and the second ions preferably have a second polarity which is preferably opposite to the first polarity.

The Electron Transfer Dissociation or Proton Transfer Reaction device preferably further comprises a first RF device arranged and adapted to apply a first AC or RF voltage having a first frequency and a first amplitude to at least some of the plurality of electrodes such that, in use, ions are confined radially within the ion guide.

The first frequency is preferably selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The first amplitude is preferably selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

In a mode of operation adjacent or neighbouring electrodes are preferably supplied with opposite phase of the first AC or RF voltage.

The ion guide preferably comprises 1-10, 10-20, 20-30, 30-40, 40-50, 50-60, 60-70, 70-80, 80-90, 90-100 or >100 groups of electrodes, wherein each group of electrodes comprises at least 1, 2, 3, 4, 5, 6, 7, 8, 9, 10, 11, 12, 13, 14, 15, 16, 17, 18, 19 or 20 electrodes and wherein at least 1, 2, 3, 4, 5, 6, 7, 8, 9, 10, 11, 12, 13, 14, 15, 16, 17, 18, 19 or 20 electrodes in each group are supplied with the same phase of the first AC or RF voltage.

According to an embodiment the Electron Transfer Dissociation or Proton Transfer Reaction device preferably further comprises a device which is arranged and adapted to progressively increase, progressively decrease, progressively vary, scan, linearly increase, linearly decrease, increase in a stepped, progressive or other manner or decrease in a stepped, progressive or other manner the first frequency by $x_1$ MHz over a time period $t_1$.

According to an embodiment $x_1$ is preferably selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

According to an embodiment $t_1$ is preferably selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

The Electron Transfer Dissociation or Proton Transfer Reaction device preferably further comprises a device arranged and adapted to progressively increase, progressively decrease, progressively vary, scan, linearly increase, linearly decrease, increase in a stepped, progressive or other manner or decrease in a stepped, progressive or other manner the first amplitude by $x_2$ Volts over a time period $t_2$.

According to an embodiment $x_2$ is preferably selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

According to an embodiment $t_2$ is preferably selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

According to an embodiment the device may further comprise a device for applying a positive or negative potential at a first or upstream end of the ion guide. The positive or negative potential preferably acts to confine at least some of the first ions and/or at least some second ions within the ion guide. The potential preferably also allows at least some of the first ions and/or at least some second ions to exit the ion guide via the first or upstream end.

The device preferably further comprises a device for applying a positive or negative potential at a second or downstream end of the ion guide. The positive or negative potential preferably acts to confine at least some of the first ions and/or at least some second ions within the ion guide. The potential preferably also allows at least some of the first ions and/or at least some second ions to exit the ion guide via the second or downstream end.

According to an embodiment either:

(a) at least 1%, 5%, 10%, 20%, 30%, 40%, 50%, 60%, 70%, 80%, 90%, 95% or 100% of the electrodes have substantially circular, rectangular, square or elliptical apertures; and/or (b) at least 1%, 5%, 10%, 20%, 30%, 40%, 50%, 60%, 70%, 80%, 90%, 95% or 100% of the electrodes have apertures which are substantially the same first size or which have substantially the same first area and/or at least 1%, 5%, 10%, 20%, 30%, 40%, 50%, 60%, 70%, 80%, 90%, 95% or 100% of the electrodes have apertures which are substantially the same second different size or which have substantially the same second different area; and/or (c) at least 1%, 5%, 10%, 20%, 30%, 40%, 50%, 60%, 70%, 80%, 90%, 95% or 100% of the electrodes have apertures which become progressively larger and/or smaller in size or in area in a direction along the axis of the ion guide; and/or (d) at least 1%, 5%, 10%, 20%, 30%, 40%, 50%, 60%, 70%, 80%, 90%, 95% or 100% of the electrodes have apertures having internal diameters or dimensions selected from the group consisting of: (i) ≦1.0 mm; (ii) ≦2.0 mm; (iii) ≦3.0 mm; (iv) ≦4.0 mm; (v) ≦5.0 mm; (vi) ≦6.0 mm; (vii) ≦7.0 mm; (viii) ≦8.0 mm; (ix) ≦9.0 mm; (x) ≦10.0 mm; and (xi) >10.0 mm; and/or (e) at least 1%, 5%, 10%, 20%, 30%, 40%, 50%, 60%, 70%, 80%, 90%, 95% or 100% of the electrodes are spaced apart from one another by an axial distance selected from the group consisting of: (i) less than or equal to 5 mm; (ii) less than or equal to 4.5 mm; (iii) less than or equal to 4 mm; (iv) less than or equal to 3.5 mm; (v) less than or equal to 3 mm; (vi) less than or equal to 2.5 mm; (vii) less than or equal to 2 mm; (viii) less than or equal to 1.5 mm; (ix) less than or equal to 1 mm; (x) less than or equal to 0.8 mm; (xi) less than or equal to 0.6 mm; (xii) less than or equal to 0.4 mm; (xiii) less than or equal to 0.2 mm; (xiv) less than or equal to 0.1 mm; and (xv) less than or equal to 0.25 mm; and/or (f) at least some of the plurality of electrodes comprise apertures and wherein the ratio of the internal diameter or dimension of the apertures to the centre-to-centre axial spacing between adjacent electrodes is selected from the group consisting of: (i) <1.0; (ii) 1.0-1.2; (iii) 1.2-1.4; (iv) 1.4-1.6; (v) 1.6-1.8; (vi) 1.8-2.0; (vii) 2.0-2.2; (viii) 2.2-2.4; (ix) 2.4-2.6; (x) 2.6-2.8; (xi) 2.8-3.0; (xii) 3.0-3.2; (xiii) 3.2-3.4; (xiv) 3.4-3.6; (xv) 3.6-3.8; (xvi) 3.8-4.0; (xvii) 4.0-4.2; (xviii) 4.2-4.4; (xix) 4.4-4.6; (xx) 4.6-4.8; (xxi) 4.8-5.0; and (xxii) >5.0; and/or (g) the internal diameter of the apertures of the plurality of electrodes progressively increases or decreases and then progressively decreases or increases one or more times along the longitudinal axis of the ion guide; and/or (h) the plurality of electrodes define a geometric volume, wherein the geometric volume is selected from the group consisting of: (i) one or more spheres; (ii) one or more oblate spheroids; (iii) one or more prolate spheroids; (iv) one or more ellipsoids; and (v) one or more scalene ellipsoids; and/or (i) the ion guide has a length selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; and (xi) >200 mm; and/or (j) the ion guide comprises at least: (i) 1-10 electrodes; (ii) 10-20 electrodes; (iii) 20-30 electrodes; (iv) 30-40 electrodes; (v) 40-50 electrodes; (vi) 50-60 electrodes; (vii) 60-70 electrodes; (viii) 70-80 electrodes; (ix) 80-90 electrodes; (x) 90-100 electrodes; (xi) 100-110 electrodes; (xii) 110-120 electrodes; (xiii) 120-130 electrodes; (xiv) 130-140 electrodes; (xv) 140-150 electrodes; (xvi) 150-160 electrodes; (xvii) 160-170 electrodes; (xviii) 170-180 electrodes; (xix) 180-190 electrodes; (xx) 190-200 electrodes; and (xxi) >200 electrodes; and/or (k) at least 1%, 5%, 10%, 20%, 30%, 40%, 50%, 60%, 70%, 80%, 90%, 95% or 100% of the electrodes have a thickness or axial length selected from the group consisting of: (i) less than or equal to 5 mm; (ii) less than or equal to 4.5 mm; (iii) less than or equal to 4 mm; (iv) less than or equal to 3.5 mm; (v) less than or equal to 3 mm; (vi) less than or equal to 2.5 mm; (vii) less than or equal to 2 mm; (viii) less than or equal to 1.5 mm; (ix) less than or equal to 1 mm; (x) less than or equal to 0.8 mm; (xi) less than or equal to 0.6 mm; (xii) less than or equal to 0.4 mm; (xiii) less than or equal to 0.2 mm; (xiv) less than or equal to 0.1 mm; and (xv) less than or equal to 0.25 mm; and/or (l) the pitch or axial spacing of or between the plurality of electrodes progressively decreases or increases one or more times along the longitudinal axis of the ion guide.

According to an embodiment the device may comprise two adjacent ion tunnel sections. The electrodes in the first ion tunnel section preferably have a first internal diameter and the electrodes in the second section preferably have a second different internal diameter (which according to an embodiment may be smaller or larger than the first internal diameter). The first and/or second ion tunnel sections may be inclined to or arranged off-axis from the general central longitudinal axis of the mass spectrometer. This allows ions to be separated from neutral particles which will continually to move linearly through the vacuum chamber.

The Electron Transfer Dissociation or Proton Transfer Reaction device preferably further comprises a device arranged and adapted either:

(i) to generate a linear axial DC electric field along at least 1%, 5%, 10%, 20%, 30%, 40%, 50%, 60%, 70%, 80%, 90%, 95% or 100% of the axial length of the ion guide; or (ii) to generate a non-linear or stepped axial DC electric field along at least 1%, 5%, 10%, 20%, 30%, 40%, 50%, 60%, 70%, 80%, 90%, 95% or 100% of the axial length of the ion guide.

The Electron Transfer Dissociation or Proton Transfer Reaction device preferably further comprises:

(i) a device arranged and adapted to vary, progressively increase, progressively decrease, progressively vary, scan, linearly increase, linearly decrease, increase in a stepped, progressive or other manner or decrease in a stepped, progressive or other manner the periodicity and/or shape and/or waveform and/or pattern and/or profile of the one or more first transient DC voltages or potentials or the one or more first transient DC voltage or potential waveforms which are applied to or translated along the electrodes; and/or (ii) a device arranged and adapted to vary, progressively increase, progressively decrease, progressively vary, scan, linearly increase, linearly decrease, increase in a stepped, progressive or other manner or decrease in a stepped, progressive or other manner the periodicity and/or shape and/or waveform and/or pattern and/or profile of the one or more second transient DC voltages or potentials or the one or more second transient DC voltage or potential waveforms which are applied to or translated along the electrodes.

According to an embodiment in a mode of operation the one or more first transient DC voltages or potentials or the one or more first transient DC voltage or potential waveforms are subsequently applied to at least some of the plurality of electrodes in a different or reverse manner in order to drive or urge at least some product or fragment ions along and/or through at least a portion of the axial length of the ion guide in a direction different or reverse to the initial first direction.

According to an embodiment in a mode of operation the one or more second transient DC voltage or potentials or one or more second transient DC voltage or potential waveforms are subsequently applied to at least some of the plurality of electrodes in a different or reverse manner in order to drive or urge at least some product or fragment ions along and/or through at least a portion of the axial length of the ion guide in a direction different or reverse to the second initial direction.

According to an embodiment either a static or a dynamic ion-ion reaction region, ion-neutral gas reaction region or reaction volume may be formed or generated in the ion guide. For example, the axial position of the ion-ion reaction region, ion-neutral gas reaction region or reaction volume may be arranged to be continually translated along at least a portion of the ion guide.

The Electron Transfer Dissociation or Proton Transfer Reaction device preferably further comprises a device arranged and adapted either:

(a) to maintain the ion guide in a mode of operation at a pressure selected from the group consisting of: (i) <100 mbar; (ii) <10 mbar; (iii) <1 mbar; (iv) <0.1 mbar; (v) <0.01 mbar; (vi) <0.001 mbar; (vii) <0.0001 mbar; and (viii) <0.00001 mbar; and/or (b) to maintain the ion guide in a mode of operation at a pressure selected from the group consisting of: (i) >100 mbar; (ii) >10 mbar; (iii) >1 mbar; (iv) >0.1 mbar; (v) >0.01 mbar; (vi) >0.001 mbar; and (vii) >0.0001 mbar; and/or (c) to maintain the ion guide in a mode of operation at a pressure selected from the group consisting of: (i) 0.0001-0.001 mbar; (ii) 0.001-0.01 mbar; (iii) 0.01-0.1 mbar; (iv) 0.1-1 mbar; (v) 1-10 mbar; (vi) 10-100 mbar; and (vii) 100-1000 mbar.

According to an embodiment:

(a) the residence, transit or reaction time of at least 1%, 5%, 10%, 20%, 30%, 40%, 50%, 60%, 70%, 80%, 90%, 95% or 100% of the first ions within the ion guide is selected from the group consisting of: (i) <1 ms; (ii) 1-5 ms; (iii) 5-10 ms; (iv) 10-15 ms; (v) 15-20 ms; (vi) 20-25 ms; (vii) 25-30 ms; (viii) 30-35 ms; (ix) 35-40 ms; (x) 40-45 ms; (xi) 45-50 ms; (xii) 50-55 ms; (xiii) 55-60 ms; (xiv) 60-65 ms; (xv) 65-70 ms; (xvi) 70-75 ms; (xvii) 75-80 ms; (xviii) 80-85 ms; (xix) 85-90 ms; (xx) 90-95 ms; (xxi) 95-100 ms; (xxii) 100-105 ms; (xxiii) 105-110 ms; (xxiv) 110-115 ms; (xxv) 115-120 ms; (xxvi) 120-125 ms; (xxvii) 125-130 ms; (xxviii) 130-135 ms; (xxix) 135-140 ms; (xxx) 140-145 ms; (xxxi) 145-150 ms; (xxxii) 150-155 ms; (xxxiii) 155-160 ms; (xxxiv) 160-165 ms; (xxxv) 165-170 ms; (xxxvi) 170-175 ms; (xxxvii) 175-180 ms; (xxxviii) 180-185 ms; (xxxix) 185-190 ms; (xl) 190-195 ms; (xli) 195-200 ms; and (xlii) >200 ms; and/or (b) the residence, transit or reaction time of at least 1%, 5%, 10%, 20%, 30%, 40%, 50%, 60%, 70%, 80%, 90%, 95% or 100% of second ions within the ion guide is selected from the group consisting of: (i) <1 ms; (ii) 1-5 ms; (iii) 5-10 ms; (iv) 10-15 ms; (v) 15-20 ms; (vi) 20-25 ms; (vii) 25-30 ms; (viii) 30-35 ms; (ix) 35-40 ms; (x) 40-45 ms; (xi) 45-50 ms; (xii) 50-55 ms; (xiii) 55-60 ms; (xiv) 60-65 ms; (xv) 65-70 ms; (xvi) 70-75 ms; (xvii) 75-80 ms; (xviii) 80-85 ms; (xix) 85-90 ms; (xx) 90-95 ms; (xxi) 95-100 ms; (xxii) 100-105 ms; (xxiii) 105-110 ms; (xxiv) 110-115 ms; (xxv) 115-120 ms; (xxvi) 120-125 ms; (xxvii) 125-130 ms; (xxviii) 130-135 ms; (xxix) 135-140 ms; (xxx) 140-145 ms; (xxxi) 145-150 ms; (xxxii) 150-155 ms; (xxxiii) 155-160 ms; (xxxiv) 160-165 ms; (xxxv) 165-170 ms; (xxxvi) 170-175 ms; (xxxvii) 175-180 ms; (xxxviii) 180-185 ms; (xxxix) 185-190 ms; (xl) 190-195 ms; (xli) 195-200 ms; and (xlii) >200 ms; and/or (c) the residence, transit or reaction time of at least 1%, 5%, 10%, 20%, 30%, 40%, 50%, 60%, 70%, 80%, 90%, 95% or 100% of product or fragment ions created or formed within the ion guide is selected from the group consisting of: (i) <1 ms; (ii) 1-5 ms; (iii) 5-10 ms; (iv) 10-15 ms; (v) 15-20 ms; (vi) 20-25 ms; (vii) 25-30 ms; (viii) 30-35 ms; (ix) 35-40 ms; (x) 40-45 ms; (xi) 45-50 ms; (xii) 50-55 ms; (xiii) 55-60 ms; (xiv) 60-65 ms; (xv) 65-70 ms; (xvi) 70-75 ms; (xvii) 75-80 ms; (xviii) 80-85 ms; (xix) 85-90 ms; (xx) 90-95 ms; (xxi) 95-100 ms; (xxii) 100-105 ms; (xxiii) 105-110 ms; (xxiv) 110-115 ms; (xxv) 115-120 ms; (xxvi) 120-125 ms; (xxvii) 125-130 ms; (xxviii) 130-135 ms; (xxix) 135-140 ms; (xxx) 140-145 ms; (xxxi) 145-150 ms; (xxxii) 150-155 ms; (xxxiii) 155-160 ms; (xxxiv) 160-165 ms; (xxxv) 165-170 ms; (xxxvi) 170-175 ms; (xxxvii) 175-180 ms; (xxxviii) 180-185 ms; (xxxix) 185-190 ms; (xl) 190-195 ms; (xli) 195-200 ms; and (xlii) > 200 ms.

The ion guide is preferably arranged to have a cycle time selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s. The cycle time preferably corresponds to one cycle of reacting analyte ions with reagent ions or neutral reagent gas and then extracting the resulting product or fragment ions from the device and/or the rate at which analyte ions and/or reagent ions are input into the reaction device.

According to an embodiment:

(a) in a mode of operation first ions and/or second ions are arranged and adapted to be trapped but not substantially fragmented and/or reacted and/or charge reduced within the ion guide; and/or (b) in a mode of operation first ions and/or second ions are arranged and adapted to be collisionally cooled or substantially thermalised within the ion guide; and/or (c) in a mode of operation first ions and/or second ions are arranged and adapted to be substantially fragmented and/or reacted and/or charge reduced within the ion guide; and/or (d) in a mode of operation first ions and/or second ions are arranged and adapted to be pulsed into and/or out of the ion guide by means of one or more electrodes arranged at the entrance and/or exit of the ion guide.

According to an embodiment:

(a) in a mode of operation ions are predominantly arranged to fragment by Collision Induced Dissociation to form product or fragment ions, wherein the product or fragment ions comprise a majority of b-type product or fragment ions and/or y-type product or fragment ions; and/or (b) in a mode of operation ions are predominantly arranged to fragment by Electron Transfer Dissociation to form product or fragment ions, wherein the product or fragment ions comprise a majority of c-type product or fragment ions and/or z-type product or fragment ions.

According to an embodiment in order to effect Electron Transfer Dissociation either:

(a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged (preferably basic) gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged (preferably superbase) reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions preferably comprise peptides, polypeptides, proteins or biomolecules.

According to an embodiment in order to effect Electron Transfer Dissociation the reagent anions or negatively charged ions may be derived from a polyaromatic hydrocarbon or a substituted polyaromatic hydrocarbon. The reagent anions or negatively charged ions may be derived from a low electron affinity substrate. According to an embodiment the reagent ions may be derived from the group consisting of: (i) anthracene; (ii) 9,10 diphenyl-anthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone. The reagent ions or negatively charged ions may comprise azobenzene anions or azobenzene radical anions. Other embodiments are contemplated wherein the reagent ions comprise other ions, radical anions or metastable ions.

According to an embodiment in order to effect Proton Transfer Reaction protons may be transferred from one or more multiply charged analyte cations or positively charged ions to one or more reagent anions or negatively charged ions whereupon at least some of the multiply charged analyte cations or positively charged ions are preferably reduced in charge state. It is also contemplated that some of the cations may also be induced to dissociate and form product or fragment ions.

Protons may be transferred from one or more multiply charged analyte cations or positively charged ions to one or more neutral, non-ionic or uncharged reagent gases or vapours whereupon at least, some of the multiply charged analyte cations or positively charged ions are preferably reduced in charge state. It is also contemplated that some of the cations may also be induced to dissociate and form product or fragment ions.

The multiply charged analyte cations or positively charged ions preferably comprise peptides, polypeptides, proteins or biomolecules.

According to an embodiment in order to effect Proton Transfer Reaction the reagent anions or negatively charged ions may be derived from a compound selected from the group consisting of: (i) carboxylic acid; (ii) phenolic; and (iii) a compound containing alkoxide. The reagent anions or negatively charged ions may alternatively be derived from a compound selected from the group consisting of: (i) benzoic acid; (ii) perfluoro-1,3-dimethylcyclohexane or PDCH; (iii) sulphur hexafluoride or SF6; and (iv) perfluorotributylamine or PFTBA.

According to an embodiment the one or more reagent gases or vapours used to effect Proton Transfer Reaction may comprise a superbase gas. According to an embodiment the one or more reagent gases or vapours may be selected from the group consisting of: (i) 1,1,3,3-Tetramethylguanidine ("TMG"); (ii) 2,3,4,6,7,8,9,10-Octahydropyrimidol[1,2-a] azepine {Synonym: 1,8-Diazabicyclo[5.4.0]undec-7-ene ("DBU")}; or (iii) 7-Methyl-1,5,7-triazabicyclo[4.4.0]dec-5-ene ("MTBD") {Synonym: 1,3,4,6,7,8-Hexahydro-1-methyl-2H-pyrimido[1,2-a]pyrimidine}.

Further embodiments are contemplated wherein the same reagent ions or neutral reagent gas which is disclosed above in relation to effecting Electron Transfer Dissociation may also be used to effect Proton Transfer Reaction.

According to an aspect of the present invention there is provided an mass spectrometer comprising an Electron Transfer Dissociation or Proton Transfer Reaction device as described above.

According to an embodiment the mass spectrometer preferably further comprises either:

(a) an ion source arranged upstream and/or downstream of the Electron Transfer Dissociation or Proton Transfer Reaction device, wherein the ion source is selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; and (xx) a Glow Discharge ("GD") ion source; and/or (b) one or more continuous or pulsed ion sources; and/or (c) one or more ion guides arranged upstream and/or downstream of the Electron Transfer Dissociation or Proton Transfer Reaction device; and/or (d) one or more ion mobility separation devices and/or one or more Field Asymmetric Ion Mobility Spectrometer devices arranged upstream and/or downstream of the Electron Transfer Dissociation or Proton Transfer Reaction device; and/or (e) one or more ion traps or one or more ion trapping regions arranged upstream and/or downstream of the Electron Transfer Dissociation or Proton Transfer Reaction device; and/or (f) one or more collision, fragmentation or reaction cells arranged upstream and/or downstream of the Electron Transfer Dissociation or Proton Transfer Reaction device, wherein the one or more collision, fragmentation or reaction cells are selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers arranged upstream and/or downstream of the Electron Transfer Dissociation or Proton Transfer Reaction device; and/or (i) one or more ion detectors arranged upstream and/or downstream of the Electron Transfer Dissociation or Proton Transfer Reaction device; and/or (j) one or more mass filters arranged upstream and/or downstream of the Electron Transfer Dissociation or Proton Transfer Reaction device, wherein the one or more mass filters are selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wein filter; and/or (k) a device or ion gate for pulsing ions into the Electron Transfer Dissociation or Proton Transfer Reaction device; and/or (l) a device for converting a substantially continuous ion beam into a pulsed ion beam.

The mass spectrometer preferably further comprises:

(a) one or more Atmospheric Pressure ion sources for generating analyte ions and/or reagent ions; and/or (b) one or more Electrospray ion sources for generating analyte ions and/or reagent ions; and/or (c) one or more Atmospheric Pressure Chemical ion sources for generating analyte ions and/or reagent ions; and/or (d) one or more Glow Discharge ion sources for generating analyte ions and/or reagent ions.

One or more Glow Discharge ion sources are preferably provided in one or more vacuum chambers of the mass spectrometer.

According to an embodiment a dual mode ion source or a twin ion source may be provided. For example, according to an embodiment an Electrospray ion source may be used to generate positive analyte ions and an Atmospheric Pressure Chemical Ionisation ion source may be used to generate negative reagent ions. Embodiments are also contemplated wherein a single ion source such as an Electrospray ion source, an Atmospheric Pressure Chemical Ionisation ion source or a Glow Discharge ion source may be used to generate analyte and/or reagent ions.

According to an embodiment the mass spectrometer comprises:

a C-trap; and an orbitrap mass analyser;

wherein in a first mode of operation ions are transmitted to the C-trap and are then injected into the orbitrap mass analyser; and wherein in a second mode of operation ions are transmitted to the C-trap and then to a collision cell or the Electron Transfer Dissociation and/or Proton Transfer Reaction device wherein at least some ions are fragmented into fragment ions, and wherein the fragment ions are then transmitted to the C-trap before being injected into the orbitrap mass analyser.

The collision cell preferably comprises the Electron Transfer Dissociation device and/or the Proton Transfer Reaction device according to the preferred embodiment.

According to another aspect of the present invention there is provided a computer program executable by the control system of a mass spectrometer comprising an Electron Transfer Dissociation or Proton Transfer Reaction device comprising a plurality of electrodes having at least one aperture, wherein ions are transmitted in use through the apertures, the computer program being arranged to cause the control system:

(i) to apply one or more first transient DC voltages or potentials or one or more first transient DC voltage or potential waveforms to at least some of the plurality of electrodes in order to drive or urge at least some first ions along and/or through at least a portion of the axial length of the ion guide in a first direction.

According to another aspect of the present invention there is provided a computer readable medium comprising computer executable instructions stored on the computer readable medium, the instructions being arranged to be executable by a control system of a mass spectrometer comprising an Electron Transfer Dissociation or Proton Transfer Reaction device comprising a plurality of electrodes having at least one aperture, wherein ions are, transmitted in use through the apertures, the computer program being arranged to cause the control system:

(i) to apply one or more first transient DC voltages or potentials or one or more first transient DC voltage or potential waveforms to at least some of the plurality of electrodes in order to drive or urge at least some first ions along and/or through at least a portion of the axial length of the ion guide in a first direction.

The computer readable medium is preferably selected from the group consisting of: (i) a ROM; (ii) an EAROM; (iii) an EPROM; (iv) an EEPROM; (v) a flash memory; and (vi) an optical disk.

According to another aspect of the present invention there is provided a method of performing Electron Transfer Dissociation or Proton Transfer Reaction reactions comprising:

providing an Electron Transfer Dissociation or Proton Transfer Reaction device comprising an ion guide comprising a plurality of electrodes having at least one aperture, wherein ions are transmitted through the apertures.

The method preferably further comprises applying one or more first transient DC voltages or potentials or one or more first transient DC voltage or potential waveforms to at least some of the plurality of electrodes in order to drive or urge at least some first ions along and/or through at least a portion of the axial length of the ion guide in a first direction.

According to another aspect of the present invention there is provided a method of mass spectrometry comprising a method as described above.

According to another aspect of the present invention there is provided an Electron Transfer Dissociation device comprising an ion guide comprising a plurality of electrodes having at least one aperture, wherein ions are transmitted in use through the apertures.

A first device is preferably arranged and adapted to apply one or more first transient DC voltages or potentials or one or more first transient DC voltage or potential waveforms to at least some of the plurality of electrodes in order to drive or urge at least some multiply charged analyte cations along and/or through at least a portion of the axial length of the ion guide in a first direction.

At least some of the multiply charged analyte cations are preferably caused to interact with at least some reagent ions or neutral reagent gas and wherein at least some electrons are preferably transferred from the reagent ions or the neutral reagent gas to at least some of the multiply charged analyte cations whereupon at least some of the multiply charged analyte cations are induced to dissociate to form product or fragment ions.

According to an aspect of the present invention there is provided a method of performing Electron Transfer Dissociation comprising providing an ion guide comprising a plurality of electrodes having at least one aperture, wherein ions are transmitted through the apertures.

The method preferably further comprises applying one or more first transient DC voltages or potentials or one or more first transient DC voltage or potential waveforms to at least some of the plurality of electrodes in order to drive or urge at least some multiply charged analyte cations along and/or through at least a portion of the axial length of the ion guide in a first direction.

At least some of the multiply charged analyte cations are preferably caused to interact with at least some reagent ions or neutral reagent gas and wherein at least some electrons are transferred from the reagent ions or neutral reagent gas to at least some of the multiply charged analyte cations whereupon at least some of the multiply charged analyte cations are induced to dissociate to form product or fragment ions.

According to another aspect of the present invention there is provided an Electron Transfer Dissociation device and/or a Proton Transfer Reaction device comprising an ion guide comprising a plurality of electrodes having at least one aperture, wherein reagent and/or analyte ions are transmitted in use through the apertures.

According to another aspect of the present invention there is provided a method of Electron Transfer Dissociation and/or Proton Transfer Reaction comprising:

performing Electron Transfer Dissociation and/or Proton Transfer Reaction in a reaction device comprising an ion guide comprising a plurality of electrodes having at least one aperture, wherein reagent and/or analyte ions are transmitted through the apertures.

According to an aspect of the present invention there is provided a method of performing Electron Transfer Dissociation or Proton Transfer Reaction, comprising:

providing an ion guide comprising a plurality of electrodes each having at least one aperture, wherein ions are transmitted through the apertures;

providing, in the ion guide, ions comprising analyte cations and/or reagent anions; and applying one or more first transient DC voltages to at least some of the plurality of electrodes to urge at least some of the ions in a first direction along at least a first portion of the axial length of the ion guide;

wherein at least some of the analyte cations are caused to interact with at least some reagent ions or neutral reagent gas whereupon at least some of the analyte cations dissociate to form fragment ions.

According to another aspect of the present invention there is provided an Electron Transfer Dissociation or Proton Transfer Reaction device comprising:

an ion guide comprising a plurality of electrodes each having at least one aperture, wherein ions are transmitted through the apertures;

a source for introducing analyte cations and/or reagent anions into the ion guide;

a control system comprising a computer readable medium that has stored therein computer executable instructions that, when executed by the control system, causes the control system to implement the step of:

(i) applying one or more first transient DC voltages to at least some of the plurality of electrodes to urge at least some of the ions in a first direction along at least a first portion of the axial length of the ion guide; and wherein at least some of the analyte cations are caused to interact with at least some reagent ions or neutral reagent gas whereupon at least some of the analyte cations dissociate to form fragment ions.

The preferred embodiment relates to an ion-ion reaction device and/or ion-neutral gas reaction device wherein one or more travelling wave or electrostatic fields are preferably applied to the electrodes of an RF ion guide. The RF ion guide preferably comprises a plurality of electrodes having apertures through which ions are transmitted in use. The one or more travelling wave or electrostatic fields preferably comprise one or more transient DC voltages or potentials or one or more transient DC voltage or potential waveforms which are preferably applied to the electrodes of the ion guide.

The preferred embodiment relates to an apparatus for mass spectrometry which is designed to spatially manipulate ions having opposing charges in order to facilitate ion-ion reactions. In particular, the apparatus is arranged and adapted to perform Electron Transfer Dissociation ("ETD") fragmentation and/or Proton Transfer Reaction ("PTR") charge state reduction of ions.

According to an embodiment negatively charged reagent ions (or neutral reagent gas) may be loaded into or otherwise provided or located in an ion-ion reaction or ion neutral gas reaction device. Negatively charged reagent ions may, for example, be transmitted into an ion-ion reaction device by applying a DC travelling wave or one or more transient DC voltages or potentials to the electrodes forming the ion-ion reaction device.

Once the reagent anions (or neutral reagent gas) has been loaded into the ion-ion reaction device (or ion-neutral gas reaction device), multiply charged analyte cations may then preferably be driven or urged through or into the reaction device preferably by means of one or more subsequent or separate DC travelling waves. The one or more DC travelling waves are preferably applied to the electrodes of the reaction device.

The one or more DC travelling waves preferably comprise one or more transient DC voltages or potentials or one or more transient DC voltage or potential waveforms which preferably cause ions to be translated or urged along at least a portion of the axial length of the ion guide. Ions are therefore effectively translated along the length of the ion guide by one or more real or DC potential barriers which are preferably applied sequentially to electrodes along the length of the ion guide, ion-ion reaction device or ion-neutral gas reaction device. As a result, positively charged analyte ions trapped between DC potential barriers are preferably translated along the length of the ion guide, ion-ion reaction device or ion-neutral gas reaction device and are preferably driven or urged through and into close proximity with negatively, charged reagent ions (or neutral reagent gas) which is preferably already present in or within the ion guide or reaction device.

A particular advantage of this embodiment is that optimum conditions for ion-ion reactions and/or ion-neutral gas reactions are preferably achieved within the ion guide, ion-ion reaction device or ion-neutral gas reaction device. In particular, the kinetic energies of the reagent anions (or reagent gas) and the analyte cations can be closely matched. The residence time of product or fragment ions which result from the Electron Transfer Dissociation (or Proton Transfer Reaction) process can be carefully controlled so that the resulting fragment or product ions are not then duly neutralised.

The preferred embodiment of the present invention therefore represents a significant improvement over conventional arrangements in the ability to carry out Electron Transfer Dissociation and/or Proton Transfer Reaction efficiently on mainstream (i.e. non-FTICR) commercial mass spectrometers.

The speed and/or the amplitude of the one or more DC travelling waves which are preferably used to translate e.g. positively charged analyte ions through the ion guide, ion-ion reaction device or ion-neutral gas reaction device may be controlled in order to optimise the fragmentation of the analyte ions by Electron Transfer Dissociation and/or the charge state reduction of analyte ions by Proton Transfer Reaction. If positively charged fragment or product ions resulting from the Electron Transfer Dissociation (or Proton Transfer Reaction) process are allowed to remain for too long in the ion guide, ion-ion reaction device or ion-neutral gas reaction device after they have been formed, then they are likely to be neutralised. The preferred embodiment enables positively charged fragment or product ions to be removed or extracted from the ion guide, ion-ion reaction device or ion-neutral gas reaction device soon after they are formed within the ion guide, ion-ion reaction device or ion-neutral gas reaction.

According to the preferred embodiment a negative potential or potential barrier may optionally be applied at the front (e.g. upstream) end and also at the rear (e.g. downstream) end of the ion guide, ion-ion reaction device or ion-neutral gas reaction device. The negative potential or potential barrier preferably acts to confine negatively charged reagent ions within the ion guide whilst at the same time allowing or causing positively charged product or fragment ions which are created within the ion guide, ion-ion reaction device or ion-neutral gas reaction device to emerge and exit from the ion guide, ion-ion reaction device or ion-neutral gas reaction device in a relatively fast manner. Other embodiments are also contemplated wherein analyte ions may interact with neutral gas molecules and undergo Electron Transfer Dissociation and/or Proton Transfer Reaction. If neutral reagent gas is provided then a potential barrier may or may not be provided.

Another embodiment is contemplated wherein a negative potential or potential barrier is applied only to the front (e.g. upstream) end of the ion guide. A yet further embodiment is contemplated wherein a negative potential or potential barrier is applied only to the rear (e.g. downstream) end of the ion guide. Other embodiments are contemplated wherein one or more negative potentials or potential barriers are maintained at different positions along the length of the ion guide, ion-ion reaction device or ion-neutral gas reaction device. For example, one or more negative potentials or potential barriers may be provided at one or more intermediate positions along the length of the ion guide, ion-ion reaction device or ion-neutral gas reaction device.

According to a less preferred embodiment positive analyte ions may be retained within the ion guide by one or more positive potentials and then reagent ions or neutral reagent gas may be introduced into the ion guide.

According to another embodiment two electrostatic travelling waves or DC travelling waves may be applied to the electrodes of an ion guide, ion-ion reaction device or ion-neutral gas reaction device in a substantially simultaneous manner. The travelling wave electrostatic fields or transient DC voltage waveforms are preferably arranged to move or translate ions substantially simultaneously in opposite directions towards, for example, a central region of the ion guide, ion-ion reaction device or ion-neutral gas reaction device.

The ion guide, ion-ion reaction device or ion-neutral gas reaction device preferably comprises a plurality of stacked ring electrodes which are preferably supplied with an AC or RF voltage. The electrodes preferably comprise an aperture through which ions are transmitted in use. Ions are preferably confined radially within the ion guide, ion-ion reaction device or ion-neutral gas reaction device by applying opposite phases of the AC or RF voltage to adjacent electrodes so that a radial pseudo-potential barrier is preferably generated. The radial pseudo-potential barrier preferably causes ions to be confined radially along the central longitudinal axis of the ion guide, ion-ion reaction device or ion-neutral gas reaction device. The travelling waves or plurality of transient DC potentials or voltages which are preferably applied to the electrodes of the ion guide preferably cause cations and anions (or cations and cations, or anions and anions) to be directed towards one another so that favourable conditions for ion-ion reactions and/or ion-neutral gas reactions are preferably created in the middle (or another portion or region) of the ion guide, ion-ion reaction device or ion-neutral gas reaction device.

According to an embodiment two different analyte samples may be introduced from different ends of the ion guide. Additionally or alternatively, two different species of reagent ions may be introduced into the ion guide from different ends of the ion guide.

The ion guide, ion-ion reaction device or ion-neutral gas reaction device according to the preferred embodiment preferably does not suffer from the disadvantages associated with conventional Electron Transfer Dissociation arrangements since the travelling wave electrostatic field does not generate an axial mass to charge ratio dependent RF pseudo-potential barrier. Therefore, ions are not confined within the ion guide, ion-ion reaction device or ion-neutral gas reaction device in a mass to charge ratio dependent manner.

Another advantage of the preferred embodiment is that various parameters of the one or more DC travelling waves or transient DC potentials or voltages which are applied to the electrodes of the ion guide, ion-ion reaction device or ion-neutral gas reaction device can be controlled and optimised. For example, parameters such as the wave shape, wavelength, wave profile, wave speed and the amplitude of the one or more DC travelling voltage waves can be controlled and optimised. The preferred embodiment enables the spatial location of ions in the ion guide, ion-ion reaction device or ion-neutral gas reaction device to be controlled in a flexible manner irrespective of the mass to charge ratio or polarity of the ions within the ion guide, ion-ion reaction device or ion-neutral gas reaction device.

The DC travelling wave parameters (i.e. the parameters of the one or more transient DC voltages or potentials which are applied to the electrodes) can be optimised to provide control over the relative ion velocity between cations and anions (or analyte cations and neutral reagent gas) in an ion-ion reaction or ion-neutral gas region of the ion guide or reaction device. The relative ion velocity between cations and anions or cations and neutral reagent gas is an important parameter that determines the reaction rate constant in Electron Transfer Dissociation and Protein Transfer Reaction experiments.

Other embodiments are also contemplated wherein the velocity of ion-neutral collisions can be increased using either a high speed travelling wave or by using a standing or static DC wave. Such collisions can also be used to promote Collision Induced Dissociation ("CID"). In particular, the product or fragment ions resulting from Electron Transfer Dissociation or Proton Transfer Reaction may form non-covalent bonds. These non-covalent bonds can then be broken by Collision Induced Dissociation. Collision Induced Dissociation may be performed either sequentially in space to the process of Electron Transfer Dissociation in a separate Collision Induced Dissociation cell and/or sequentially in time to the Electron Transfer Dissociation process in the same ion-ion reaction or ion-neutral gas reaction device.

According to an embodiment of the present invention the process of Electron Transfer Dissociation may be followed (or preceded) by Proton Transfer Reaction in order to reduce the charge state of the multiply charged fragment or product ions (or the analyte ions).

According to an embodiment the reagent ions used for Electron Transfer Dissociation and reagent ions used for Proton Transfer Reaction may be generated from the same or different neutral compounds. Reagent and analyte ions may be generated by the same ion source or by two or more separate ion sources.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENTS

Figure 1:
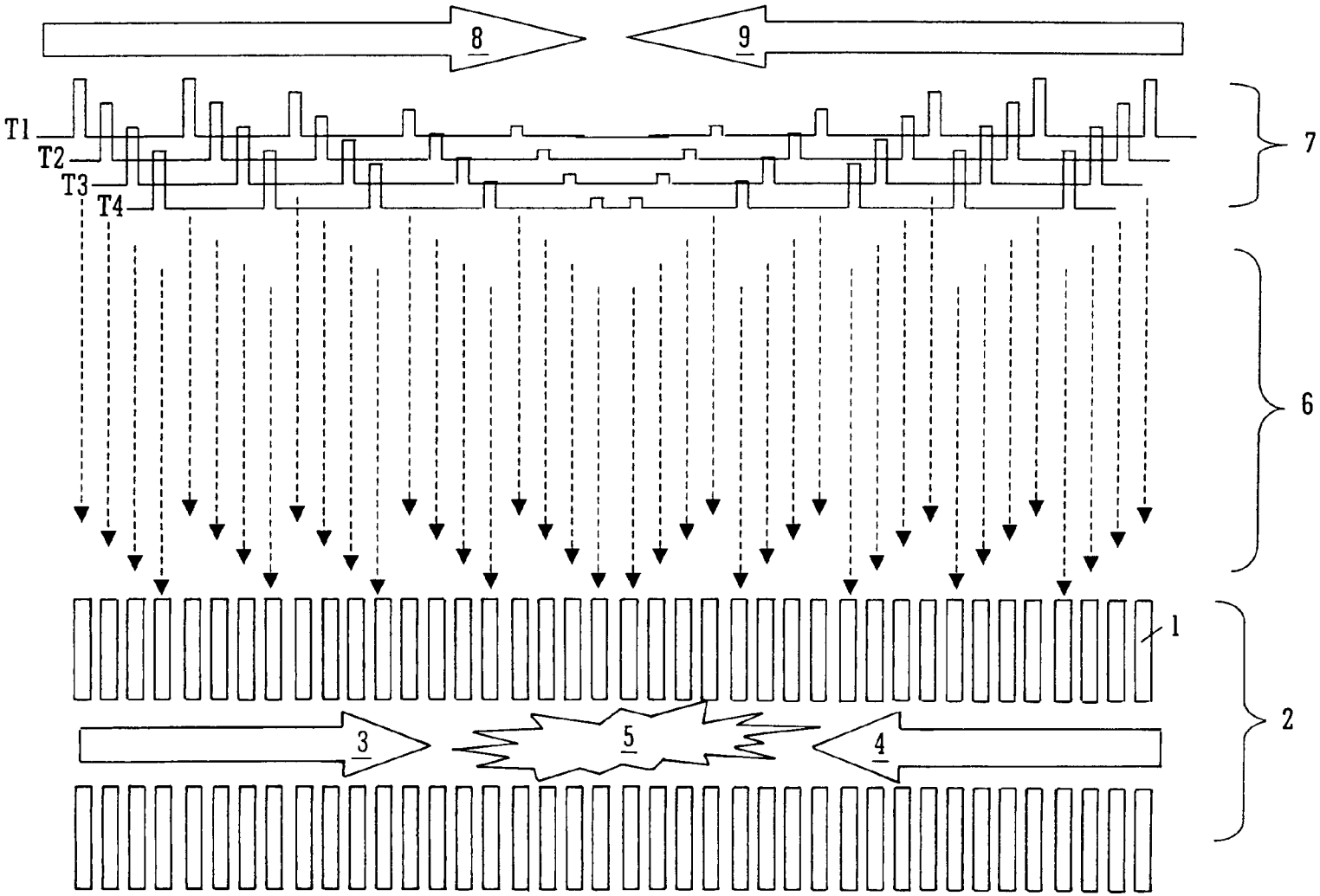
FIG. 1 shows an embodiment of the present invention wherein two transient DC voltages or potentials are applied simultaneously to the electrodes of an ion guide, ion-ion reaction device or ion-neutral gas reaction device so that analyte cations and reagent anions are brought together in the central region of the ion guide, ion-ion reaction device or ion-neutral gas reaction device.

An embodiment of the present invention will now be described in further detail with reference to FIG. 1. FIG. 1 shows a cross sectional view of the lens elements or ring electrodes 1 which together form a stacked ring ion guide, ion-ion reaction device or ion-neutral gas reaction device 2 according to a preferred embodiment of the present invention.

The ion guide, ion-ion reaction device onion-neutral gas reaction device 2 preferably comprises a plurality of electrodes 1 having one or more apertures through which ions are transmitted in use. A pattern or series of digital voltage pulses 7 is preferably applied to the electrodes 1 in use. The digital voltage pulses 7 are preferably applied in a stepped sequential manner and are preferably sequentially applied to the electrodes 1 as indicated by arrows 6. According to an embodiment as illustrated in FIG. 1, a first travelling wave 8 or series of transient DC voltages or potentials is preferably arranged to move in time from a first (upstream) end of the ion guide, ion-ion reaction device or ion-neutral gas reaction device 2 towards the middle of the ion guide, ion-ion reaction device or ion-neutral gas reaction device 2. At the same time, a second travelling wave 9 or series of transient DC voltages or potentials is preferably arranged to move in time from a second (downstream) end of the ion guide, ion-ion reaction device or ion-neutral gas reaction device 2 also towards the middle of the ion guide, ion-ion reaction device or ion-neutral gas reaction device 2. As a result, the two DC travelling waves 8,9 or series of transient DC voltages or potentials preferably converge from opposite sides of the ion guide, ion-ion reaction device or ion-neutral gas reaction device 2 towards the middle or central region of the ion guide, ion-ion reaction device or ion-neutral gas reaction device 2.

FIG. 1 shows digital voltage pulses 7 which are preferably applied to the electrodes 1 as a function of time (e.g. as an electronics timing clock progresses). The progressive nature of the application of the digital voltage pulses 7 to the electrodes 1 of the ion guide, ion-ion reaction device or ion-neutral gas reaction device 2 as a function of time is preferably indicated by arrows 6. At a first time T1, the voltage pulses indicated by T1 are preferably applied to the electrodes 1. At a subsequent time T2, the voltage pulses indicated by T2 are preferably applied to the electrodes 1. At a subsequent time T3, the voltage pulses indicated by T3 are preferably applied to the electrodes 1. Finally, at a subsequent time T4, the voltage pulses indicated by T4 are preferably applied to the electrodes 1. The voltage pulses 7 preferably have a square wave electrical potential profiles as shown.

As is also apparent from FIG. 1, the intensity or amplitude of the digital pulses 7 applied to the electrodes 1 is preferably arranged to reduce towards the middle or centre of the ion guide, ion-ion reaction device or ion-neutral gas reaction device 2. As a result, the intensity or amplitude of the digital voltage pulses 7 which are preferably applied to electrodes 1 which are close to the input or exit regions or ends of the ion guide, ion-ion reaction device or ion-neutral gas reaction device 2 are preferably greater than the intensity or amplitude of the digital voltage pulses 7 which are preferably applied to electrodes 1 in the central region of the ion guide, ion-ion reaction device or ion-neutral gas reaction device 2. Other less preferred embodiments are contemplated wherein the amplitude of the transient DC voltages or potentials or the digital voltage pulses 7 which are preferably applied to the electrodes 1 does not reduce with axial displacement along the length of the ion guide, ion-ion reaction device or ion-neutral gas reaction device 2. According to this embodiment the amplitude of the digital voltages pulses 7 may remain substantially constant with axial displacement along the length of the ion guide, ion-ion reaction device or ion-neutral gas reaction device 2.

The voltage pulses 7 which are preferably applied to the lens elements or ring electrodes 1 of the ion guide, ion-ion reaction device or ion-neutral gas reaction device 2 are preferably square waves. The electric potential within the ion guide, ion-ion reaction device or ion-neutral gas reaction device 2 preferably relaxes so that the wave function potential within the ion guide, ion-ion reaction device or ion-neutral gas reaction device 2 preferably takes on a smooth function.

Figure 2:
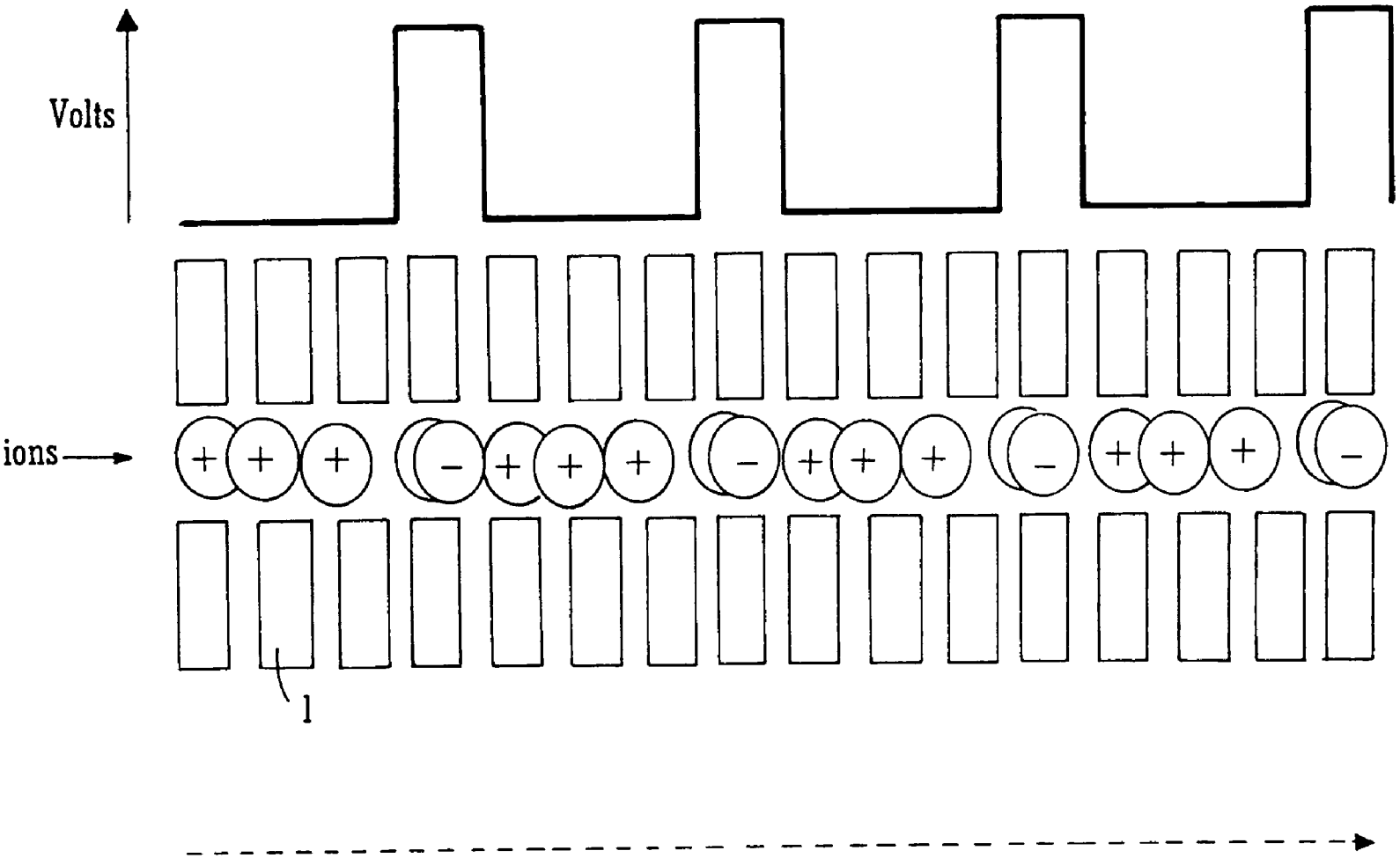
FIG. 2 illustrate how a travelling DC voltage waveform applied to the electrodes of an ion guide, ion-ion reaction device or ion-neutral gas reaction device can be used to translate simultaneously both positive and negative ions in the same direction.

According to an embodiment analyte cations (e.g. positively charged analyte ions) and/or reagent anions (e.g. negatively charged reagent ions) may be simultaneously introduced into the ion guide, ion-ion reaction device or ion-neutral gas reaction device 2 from opposite ends of the ion guide, ion-ion reaction device or ion-neutral gas reaction device 2. Once in the ion guide, ion-ion reaction device or ion-neutral gas reaction device 2, positive ions (cations) are preferably repelled by the positive (crest) potentials of the DC travelling wave or the one or more transient DC voltages or potentials which are preferably applied to the electrodes 1 of the ion guide, ion-ion reaction device or ion-neutral gas reaction device 2. As the electrostatic travelling wave moves along the length of the ion guide, ion-ion reaction device or ion-neutral gas reaction device 2, the positive ions are preferably pushed along the ion guide, ion-ion reaction device or ion-neutral gas reaction device 2 in the same direction as the travelling wave and in a manner substantially as shown in FIG. 2.

Negatively charged reagent ions (i.e. reagent anions) will be attracted towards the positive potentials of the travelling wave and will likewise be drawn, urged or attracted in the direction of the travelling wave as the travelling DC voltages or potentials move along the length of the ion guide, ion-ion reaction device or ion-neutral gas reaction device 2. As a result, whilst positive ions will preferably travel in the negative crests (positive valleys) of the travelling DC wave, negative ions will preferably travel in the positive crests (negative valleys) of the travelling DC wave or the one or more transient DC voltages or potentials.

According to an embodiment two opposed travelling DC waves 8,9 may be arranged to translate ions substantially simultaneously towards the middle or centre of the ion guide, ion-ion reaction device or ion-neutral gas reaction device 2 from both ends of the ion guide, ion-ion reaction device or ion-neutral gas reaction device 2. The travelling DC waves 8,9 are preferably arranged to move towards each other and can be considered as effectively converging or coalescing in the central region of the ion guide, ion-ion reaction device or ion-neutral gas reaction device 2. Cations and anions are preferably simultaneously carried towards the middle of the ion guide, ion-ion reaction device or ion-neutral gas reaction device 2. Less preferred embodiments are contemplated wherein analyte cations may be simultaneously introduced from different ends of the reaction device. According to this embodiment the analyte ions may be reacted with neutral reagent gas present within the reaction device or which is added subsequently to the reaction device. According to another embodiment two different species of reagent ions may be introduced (simultaneously or sequentially) into the preferred reaction device from different ends of the reaction device.

According to an embodiment cations may be translated towards the centre of the ion guide, ion-ion reaction device or ion-neutral gas reaction device 2 by a first travelling DC wave 8 and anions may be translated towards the centre of the ion guide, ion-ion reaction device or ion-neutral gas reaction device 2 by a second different travelling DC wave 9.

However, other embodiments are contemplated wherein both cations and anions may be simultaneously translated by a first travelling wave 8 towards the centre (or other region) of the ion guide, ion-ion reaction device or ion-neutral gas reaction device 2. According to this embodiment cations and/or anions may also optionally be simultaneously translated towards the centre (or other region) of the ion guide, ion-ion reaction device or ion-neutral gas reaction device 2 by a second travelling DC voltage wave 9. So for example, according to an embodiment anions and cations may be simultaneously translated by a first travelling DC wave 8 in a first direction at the same time as other anions and cations are simultaneously translated by a second travelling DC wave 9 which preferably moves in a second direction which is preferably opposed to the first direction.

According to the preferred embodiment as ions approach the middle or central region of the ion guide, ion-ion reaction device or ion-neutral gas reaction device 2, the propelling force of the travelling waves 8,9 is preferably programmed to diminish and the amplitude of the travelling waves in the central region of the ion guide, ion-ion reaction device or ion-neutral gas reaction device 2 may be arranged to become effectively zero or is otherwise at least significantly reduced. As a result, the valleys and peaks of the travelling waves preferably effectively disappear (or are otherwise significantly reduced) in the middle (centre) of the ion guide, ion-ion reaction device or ion-neutral gas reaction device 2 so that according to an embodiment ions of opposite polarity (or less preferably of the same polarity) are then preferably allowed or caused to merge and interact with each other within the central region of the ion guide, ion-ion reaction device or ion-neutral gas reaction device 2. If any ions stray randomly axially away from the middle or central region of the ion guide, ion-ion reaction device or ion-neutral gas reaction device 2 due, for example, to multiple collisions with buffer gas molecules or due to high space charge effects, then these ions will then preferably encounter subsequent travelling DC waves which will preferably have the effect of translating or urging the ions back towards the centre of the ion guide, ion-ion reaction device or ion-neutral gas reaction device 2.

According to an embodiment positive analyte ions may be arranged to be translated towards the centre of the ion guide, ion-ion reaction device or ion-neutral gas reaction device 2 by a first travelling wave 8 which is preferably arranged to move in a first direction and negative reagent ions may be arranged to be translated towards the centre of the ion guide, ion-ion reaction device or ion-neutral gas reaction device 2 by a second travelling wave 9 which is preferably arranged to move in a second direction which is opposed to the first direction.

According to other embodiments instead of applying two opposed travelling DC waves 8,9 to the electrodes 1 of the ion guide, ion-ion reaction device or ion-neutral gas reaction device 2 a single travelling DC wave may instead be applied to the electrodes 1 of the ion guide, ion-ion reaction device or ion-neutral gas reaction device 2 at any particular instance in time. According to this embodiment negatively charged reagent ions (or less preferably positively charged analyte ions) may first be loaded or directed into the ion guide, ion-ion reaction device or ion-neutral gas reaction device 2. The reagent anions are preferably translated from an entrance region of the ion guide, ion-ion reaction device or ion-neutral gas reaction device 2 along and through the ion guide, ion-ion reaction device or ion-neutral gas reaction device by a travelling DC wave. The reagent anions may be retained within the ion guide, ion-ion reaction device or ion-neutral gas reaction device 2 by applying a negative potential at the opposite end or exit end of the ion guide, ion-ion reaction device or ion-neutral gas reaction device 2.

After reagent anions (or less preferably analyte cations) have been loaded into the ion guide, ion-ion reaction device or ion-neutral gas reaction device 2, positively charged analyte ions (or less preferably negatively charged reagent ions) are then preferably translated along and through the ion guide, ion-ion reaction device or ion-neutral gas reaction device 2 by a travelling DC wave or a plurality of transient DC voltages or potentials applied to the electrodes 1.

The travelling DC wave which translates the reagent anions and the analyte cations preferably comprises one or more transient DC voltage or potentials or one or more transient DC voltage or potential waveforms which are preferably applied to the electrodes 1 of the ion guide, ion-ion reaction device or ion-neutral gas reaction device 2. The parameters of the travelling DC wave and in particular the speed or velocity at which the transient DC voltages or potentials are applied to the electrodes 1 along the length of the ion guide, ion-ion reaction device or ion-neutral gas reaction device 2 may be varied or controlled in order to optimise ion-ion reactions between the negatively charged reagent ions and the positively charged analyte ions.

Fragment or product ions which result from the ion-ion interactions are preferably swept out of the ion guide, ion-ion reaction device or ion-neutral gas reaction device 2, preferably by a DC travelling wave, before the fragment or product ions can be neutralised. Unreacted analyte ions and/or unreacted reagent ions may also be removed from the ion guide, ion-ion reaction device or ion-neutral gas reaction device 2, preferably by a DC travelling wave, if so desired. The negative potential which is preferably applied across at least the downstream end of the ion guide, ion-ion reaction device or ion-neutral gas reaction device 2 will preferably also act to accelerate positively charged product or fragment anions out of the ion guide, ion-ion reaction device or ion-neutral gas reaction device 2.

According to an embodiment a negative potential may optionally be applied to one or both ends of the ion guide, ion-ion reaction device or ion-neutral gas reaction device 2 in order to retain negatively charged ions within the ion guide, ion-ion reaction device or ion-neutral gas reaction device 2. The negative potential which is applied preferably also has the effect of encouraging or urging positively charged fragment or product ions which are created or formed within the ion guide, ion-ion reaction device or ion-neutral gas reaction device 2 to exit the ion guide, ion-ion reaction device or ion-neutral gas reaction device 2 via one or both ends of the ion guide, ion-ion reaction device or ion-neutral gas reaction device 2.

According to an embodiment positively charged fragment or product ions may be arranged to exit the ion guide, ion-ion reaction device or ion-neutral gas reaction device 2 after approximately 30 ms from formation thereby avoiding neutralisation of the positively charged fragment or product ions within the ion guide, ion-ion reaction device or ion-neutral gas reaction device 2. However, other embodiments are contemplated wherein the fragment or product ions formed within the ion guide, ion-ion reaction device or ion-neutral gas reaction device 2 may be arranged to exit the ion guide, ion-ion reaction device or ion-neutral gas reaction device 2 more quickly e.g. within a timescale of 0-10 ms, 10-20 ms or 20-30 ms. Alternatively, the fragment or product ions formed within the ion guide, ion-ion reaction device or ion-neutral gas reaction device 2 may be arranged to exit the ion guide, ion-ion reaction device or ion-neutral gas reaction device 2 more slowly e.g. within a timescale of 30-40 ms, 40-50 ms, 50-60 ms, 60-70 ms, 70-80 ms, 80-90 ms, 90-100 ms or >100 ms.

Figure 3:
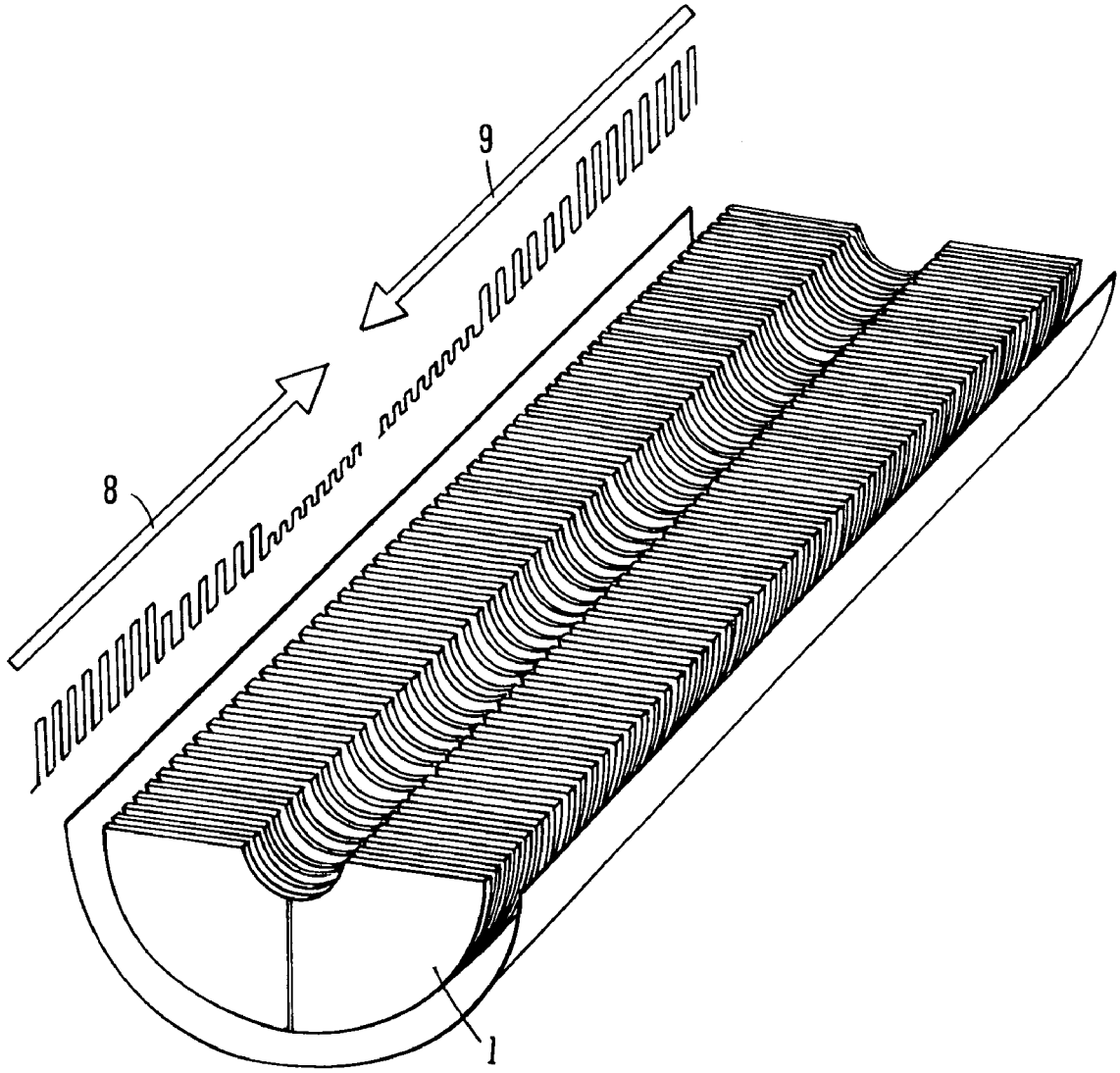
FIG. 3 shows a cross-sectional view of a SIMION® simulation of an ion guide, ion-ion reaction device or ion-neutral gas reaction device according to an embodiment of the present invention wherein two travelling DC voltage waveforms are applied simultaneously to the electrodes of the ion guide, ion-ion reaction device or ion-neutral gas reaction device and wherein the amplitude of the travelling DC voltage waveforms progressively reduces towards the centre of the ion guide, ion-ion reaction device or ion-neutral gas reaction device.

Ion motion within and through a preferred ion guide, ion-ion reaction device or ion-neutral gas reaction device 2 has been modelled using SIMION 8®. FIG. 3 shows a cross sectional view through a series of ring electrodes 1 forming an ion guide, ion-ion reaction device or ion-neutral gas reaction device 2. Ion motion through an ion guide, ion-ion reaction device or ion-neutral gas reaction device 2 as shown in FIG. 3 was modelled using SIMION 8®. FIG. 3 also shows two converging travelling DC wave voltages 8,9 or series of transient DC voltages 8,9 which were modelled as being progressively applied to the electrodes 1 forming the ion guide, ion-ion reaction device or ion-neutral gas reaction device 2 according to an embodiment of the present invention. The travelling DC wave voltages 8,9 were modelled as converging towards the centre of the ion guide, ion-ion reaction device or ion-neutral gas reaction device 2 and had the effect of simultaneously translating ions from both ends of the ion guide, ion-ion reaction device or ion-neutral gas reaction device 2 towards the centre of the ion guide, ion-ion reaction device or ion-neutral gas reaction device 2.

Figure 4:
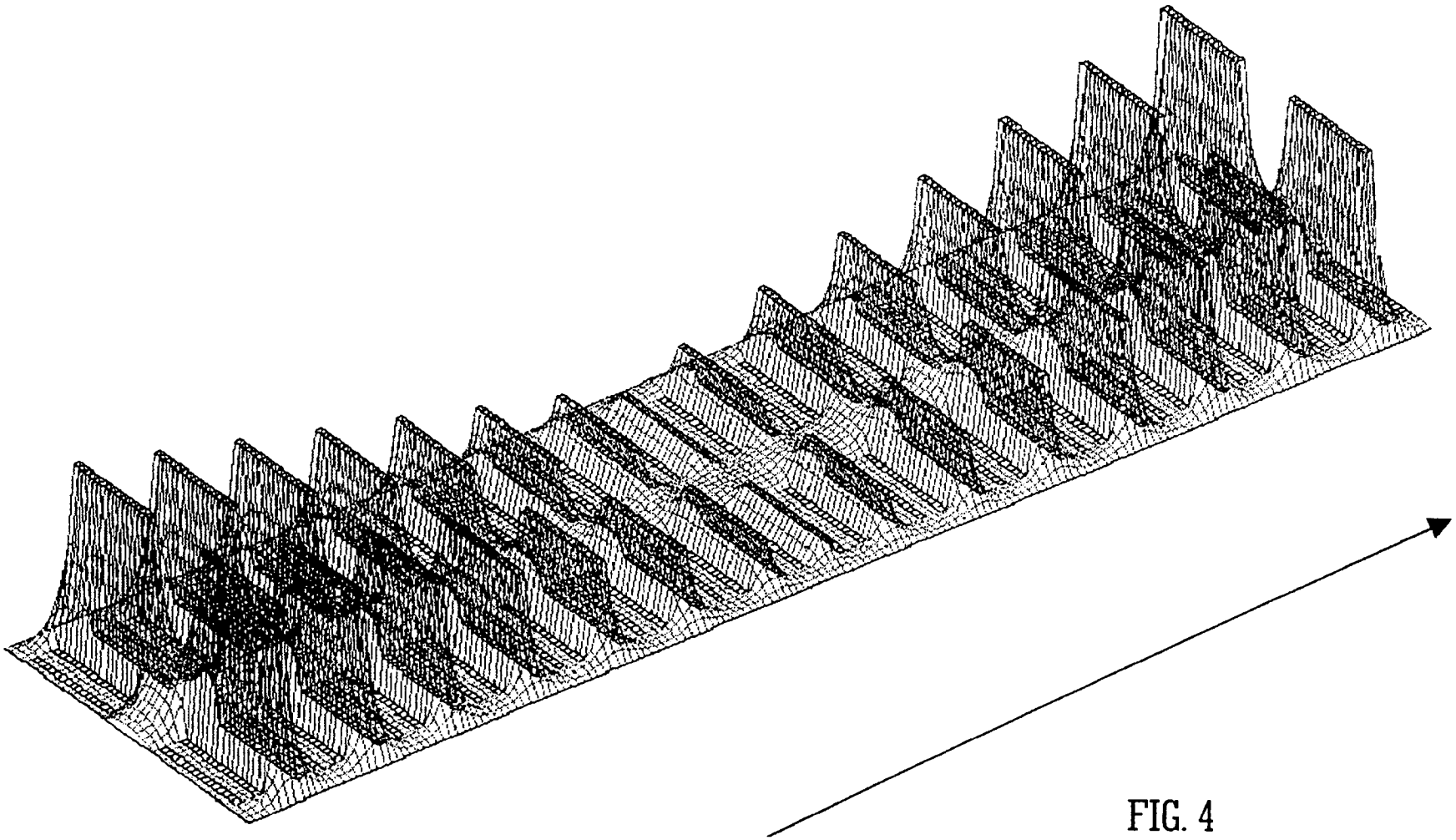
FIG. 4 shows a snap-shot of a potential energy surface within a preferred ion guide, ion-ion reaction device or ion-neutral gas reaction device when two opposing travelling DC voltage waveforms are modelled as being applied to the electrodes of the ion guide, ion-ion reaction device or ion-neutral gas reaction device and wherein the amplitude of the travelling DC voltage waveforms progressively reduces towards the centre of the ion guide, ion-ion reaction device or ion-neutral gas reaction device.

FIG. 4 shows a snap-shot of the potential energy surface within the ion guide, ion-ion reaction device or ion-neutral gas reaction device 2 at a particular instance in time as modelled by SIMION®.

Figure 5:
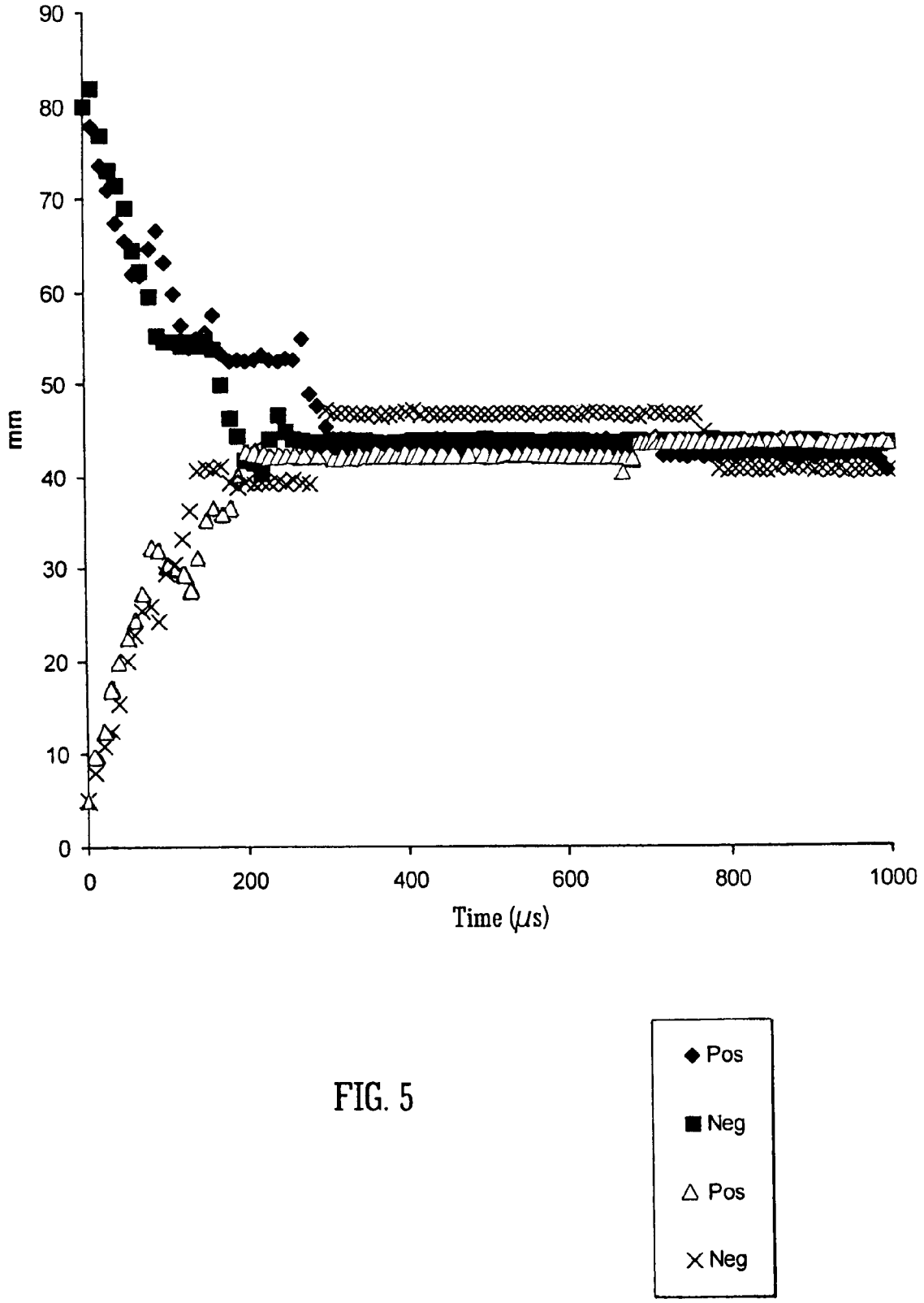
FIG. 5 shows the axial location as a function of time of two pairs of cations and anions having mass to charge ratios of 300 which were modelled as being initially provided at the ends of an ion guide, ion-ion reaction device or ion-neutral gas reaction device and wherein two opposing travelling DC voltage waveforms were modelled as being applied to the electrodes of the ion guide, ion-ion reaction device or ion-neutral gas reaction device so that ions were caused to converge in the central region of the ion guide, ion-ion reaction device or ion-neutral gas reaction device.
Figure 6A:
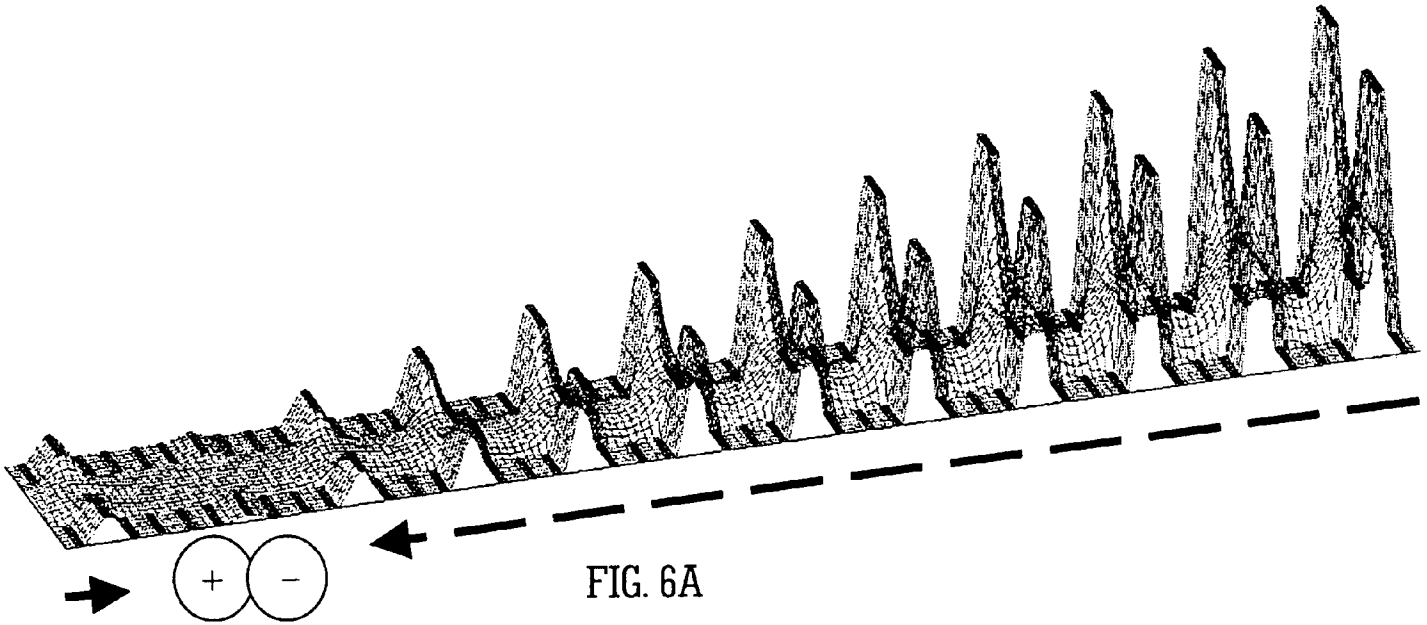
FIGS. 6A, 6B, 6C and 6D show a SIMION® simulation illustrating the potential energy within a preferred ion guide, ion-ion reaction device or ion-neutral gas reaction device according to an embodiment wherein the focal point or ion-ion reaction region is arranged to move progressively along the length of the ion guide, ion-ion reaction device or ion-neutral gas reaction device rather than remain fixed in the central region of the ion guide, ion-ion reaction device or ion-neutral gas reaction device.
Figure 6B:
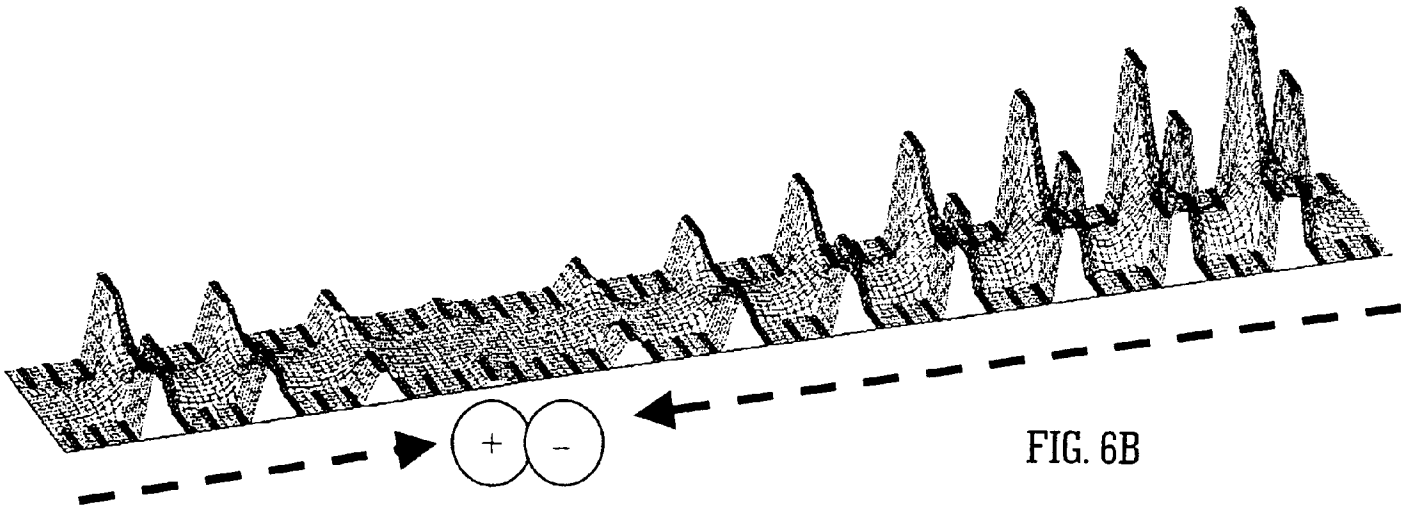
Figure 6C:
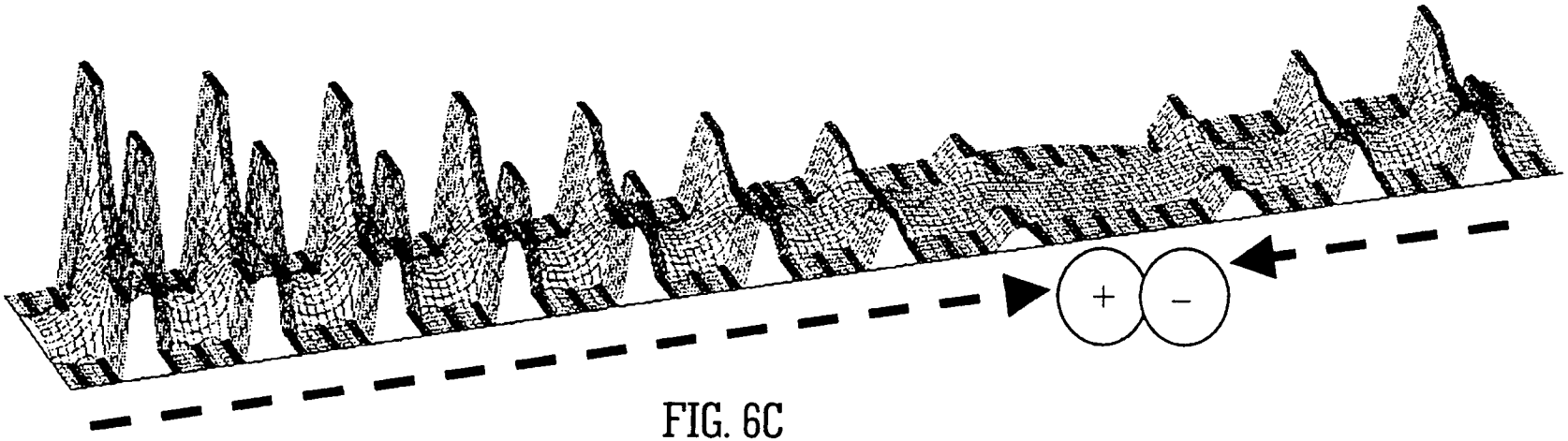
Figure 6D:
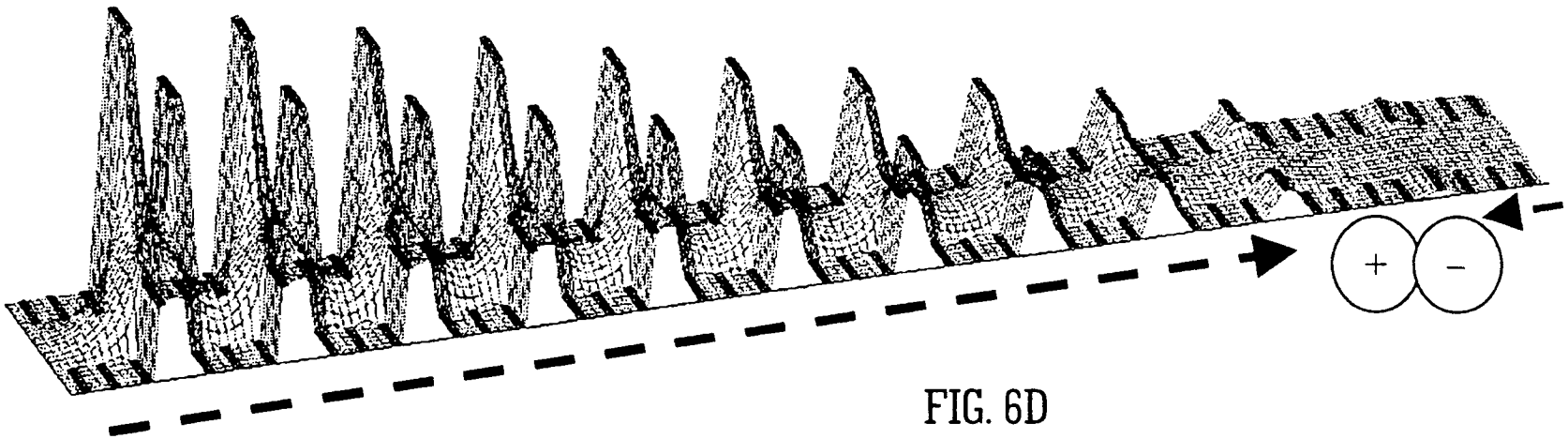

FIG. 5 shows the result of a simulation wherein a first cation and anion pair where modelled as initially being provided at the upstream end of the ion guide, ion-ion reaction device or ion-neutral gas reaction device 2 and a second cation and anion pair were modelled as initially being provided at the downstream end of the ion guide, ion-ion reaction device or ion-neutral gas reaction device. Two travelling DC voltages waves were modelled as being applied simultaneously to the electrodes 1 of the ion guide, ion-ion reaction device or ion-neutral gas reaction device 2. One travelling DC voltage wave or series of transient DC voltages was modelled as being arranged to translate ions from the front or upstream end of the ion guide, ion-ion reaction device or ion-neutral gas reaction device 2 to the centre of the ion guide, ion-ion reaction device or ion-neutral gas reaction device 2 whilst the other travelling DC voltage wave or series of transient DC voltages was modelled as being arranged to translate ions from the rear or downstream end of the ion guide, ion-ion reaction device or ion-neutral gas reaction device 2 to the centre of the ion guide, ion-ion reaction device or ion-neutral gas reaction device 2.

FIG. 5 shows the subsequent axial location of the two pairs of cations and anions as a function of time. All four ions were modelled as having a mass to charge ratio of 300. It is apparent from FIG. 5 that both pairs of ions move towards the centre or middle region of the axial length of the ion guide, ion-ion reaction device or ion-neutral gas reaction device 2 (which is located at a displacement of 45 mm) after approximately 200 μs.

The ion guide, ion-ion reaction device or ion-neutral gas reaction device 2 was modelled as comprising a plurality of stacked conductive circular ring electrodes 1 made from stainless steel. The ring electrodes were arranged to have a pitch of 1.5 mm, a thickness of 0.5 mm and a central aperture diameter of 5 mm. The travelling wave profile was modelled as advancing at 5 μs intervals so that the equivalent wave velocity towards the middle or centre of the ion guide, ion-ion reaction device or ion-neutral gas reaction device 2 was modelled as being 300 m/s. Argon buffer gas was modelled as being provided within the ion guide, ion-ion reaction device or ion-neutral gas reaction device 2 at a pressure of 0.076 Torr (i.e. 0.1 mbar). The length of the ion guide, ion-ion reaction device or ion-neutral gas reaction device 2 was modelled as being 90 mm. The typical amplitude of the voltage pulses was modelled as being 10 V. Opposing phases of a 100V RF voltage were modelled as being applied to adjacent electrodes 1 forming the ion guide, ion-ion reaction device or ion-neutral gas reaction device 2 so that ions were confined radially within the ion guide, ion-ion reaction device or ion-neutral gas reaction device 2 within a radial pseudo-potential valley.

It will be apparent from FIG. 5 that within the central region of the ion guide, ion-ion reaction device or ion-neutral gas reaction device 2 ions having opposing polarities will be located together in close proximity and at relatively low and substantially equal kinetic energies. An ion-ion reaction region is therefore preferably provided or created within the central region of the ion guide, ion-ion reaction device or ion-neutral gas reaction device 2. Furthermore, the conditions for ion-ion interactions are substantially optimised.

The location or site of ion-ion reactions within the ion guide, ion-ion reaction device or ion-neutral gas reaction device 2 may be referred to as being a focal point of the ion guide, ion-ion reaction device or ion-neutral gas reaction device 2 in the sense that the focal point of the ion guide, ion-ion reaction device or ion-neutral gas reaction device 2 can be considered as being the place where reagent anions and analyte cations come into close proximity with one another and hence can interact with one another. Opposing travelling waves 8,9 may according to one embodiment be arranged to meet at the focal point or reaction volume. The amplitude of the travelling DC voltage waves 8,9 or transient DC voltages or potentials may be arranged to decay to substantially zero amplitude at the focal point or reaction volume.

As soon as any ion-ion reactions (or ion-neutral gas reactions) have occurred, any resulting product or fragment ions may be arranged to be swept out or otherwise translated away from the reaction volume of the ion guide, ion-ion reaction device or ion-neutral gas reaction device 2 preferably relatively quickly. According to one embodiment the resulting product or fragment ions are preferably caused to exit the ion guide, ion-ion reaction device or ion-neutral gas reaction device 2 and may then be onwardly transmitted to a mass analyser such as a Time of Flight mass analyser or an ion detector.

Product or fragment ions formed within the ion guide, ion-ion reaction device or ion-neutral gas reaction device 2 may be extracted in various ways. In relation to embodiments wherein two opposed travelling DC voltage waves 8,9 are applied to the electrodes 1 of the ion guide, ion-ion reaction device or ion-neutral gas reaction device, the direction of travel of the travelling DC wave 9 applied to the downstream region or exit region of the ion guide, ion-ion reaction device or ion-neutral gas reaction device 2 may be reversed. The travelling DC wave amplitude may also be normalised along the length of the ion guide, ion-ion reaction device or ion-neutral gas reaction device 2 so that the ion guide, ion-ion reaction device or ion-neutral gas reaction device 2 is then effectively operated as a conventional travelling wave ion guide i.e. a single constant amplitude travelling DC voltage wave moving in a single direction is applied across substantially the whole of the ion guide, ion-ion reaction device or ion-neutral gas reaction device 2.

Similarly, in relation to embodiments wherein a single travelling DC voltage wave initially loads reagent anions into the ion guide, ion-ion reaction device or ion-neutral gas reaction device 2 and then analyte cations are subsequently loaded into the ion guide, ion-ion reaction device or ion-neutral gas reaction device 2 by the same travelling DC voltage wave, the single travelling DC voltage wave will also act to extract positively charged fragment or product ions which are created within the ion guide, ion-ion reaction device or ion-neutral gas reaction device 2. The travelling DC voltage wave amplitude may be normalised along the length of the ion guide, ion-ion reaction device or ion-neutral gas reaction device 2 once fragment or product ions have been created so that the ion guide, ion-ion reaction device or ion-neutral gas reaction device 2 is effectively operated as a conventional travelling wave ion guide.

It has been shown that if ions are translated by a travelling wave field through an ion guide which is maintained at a sufficiently high pressure (e.g. >0.1 mbar) then the ions may emerge from the end of the travelling wave ion guide in order of their ion mobility. Ions having relatively high ion mobilities will preferably emerge from the ion guide prior to ions having relatively low ion mobilities. Therefore, further analytical benefits such as improved sensitivity and duty cycle can be provided according to embodiments of the present invention by exploiting ion mobility separations of the product or fragment ions that are generated in the central region of the ion guide, ion-ion reaction device or ion-neutral gas reaction device 2.

According to an embodiment an ion mobility spectrometer or separation stage may be provided upstream and/or downstream of the ion guide, ion-ion reaction device or ion-neutral gas reaction device 2. For example, according to an embodiment product or fragment ions which have been formed within the ion guide, ion-ion reaction device or ion-neutral gas reaction device 2 and which have been subsequently extracted from the ion guide, ion-ion reaction device or ion-neutral gas reaction device 2 may then be separated according to their ion mobility (or less preferably according to their rate of change of ion mobility with electric field strength) in an ion mobility spectrometer or separator which is preferably arranged downstream of the ion guide, ion-ion reaction device or ion-neutral gas reaction device 2.

According to an embodiment the diameters of the internal apertures of the ring electrodes 1 forming the ion guide, ion-ion reaction device or ion-neutral gas reaction device 2 may be arranged to increase progressively with electrode position along the length of the ion guide, ion-ion reaction device or ion-neutral gas reaction device 2. The aperture diameters may be arranged, for example, to be smaller at the entry and exit sections of the ion guide, ion-ion reaction device or ion-neutral gas reaction device 2 and to be relatively larger nearer the centre or middle of the ion guide, ion-ion reaction device or ion-neutral gas reaction device 2. This will have the effect of reducing the amplitude of the DC potential experienced by ions within the central region of the ion guide, ion-ion reaction device or ion-neutral gas reaction device 2 whilst the amplitude of the DC voltages applied to the various electrodes 1 can be kept substantially constant. The travelling wave ion guide potential will therefore be at a minimum in the middle or central region of the ion guide, ion-ion reaction device or ion-neutral gas reaction device 2 according to this embodiment.

According to another embodiment both the ring aperture diameter as well as the amplitude of the transient DC voltages or potentials applied to the electrodes 1 may be varied along the length of the ion guide, ion-ion reaction device or ion-neutral gas reaction device 2.

In embodiments wherein the diameter of the aperture of the ring electrodes increases towards the centre of the ion guide, ion-ion reaction device or ion-neutral gas reaction device 2, the RF field near the central axis will also decrease. Advantageously, this will give rise to less RF heating of ions in the central region of the ion guide, ion-ion reaction device or ion-neutral gas reaction device 2. This effect can be particularly beneficial in optimising Electron Transfer Dissociation type reactions and minimising collision induced reactions.

According to a further embodiment the position of the focal point or reaction region within the ion guide, ion-ion reaction device or ion-neutral gas reaction device 2 may be moved or varied axially along the length of the ion guide, ion-ion reaction device or ion-neutral gas reaction device 2 as a function of time. This has the advantage in that ions can be arranged to be flowing or passing continuously through the ion guide, ion-ion reaction device or ion-neutral gas reaction device 2 without stopping in a central reaction region. This allows a continuous process of introducing analyte ions and reagent ions at the entrance of the ion guide, ion-ion reaction device or ion-neutral gas reaction device 2 and ejecting product or fragment ions from the exit of the ion guide, ion-ion reaction device or ion-neutral gas reaction device 2 to be achieved. Various parameters such as the speed of translation of the focal point may be varied or controlled in order to optimise the ion-ion reaction efficiency. The motion of the focal point can be achieved or controlled electronically in a stepwise fashion by switching or controlling the voltages applied to the appropriate lenses or ring electrodes 1.

The motion of ions within an ion guide or ion-ion reaction region 2 wherein the focal point is varied with time has been investigated using SIMION®. FIGS. 6A-6D illustrate the potential energy surface within the ion guide, ion-ion reaction device or ion-neutral gas reaction device 2 at different points in time according to an embodiment wherein the axial position of the focal point or reaction region varies with time. The dashed arrows depict the direction of opposed travelling wave DC voltages which are preferably applied to the electrodes 1 of the ion guide, ion-ion reaction device or ion-neutral gas reaction device 2 according to an embodiment of the present invention. It can be seen from FIGS. 6A-6D that the intensity of the travelling DC wave voltages has been programmed to increase linearly with distance or displacement away from the focal point. However, various other amplitude functions for the travelling DC voltage waves may alternatively be used. It can also be seen that the motion of the reaction region or focal point can be programmed, for example, to progress from the entrance (i.e. left) of the ion guide, ion-ion reaction device or ion-neutral gas reaction device 2 to the exit (i.e. right) of the ion guide, ion-ion reaction device or ion-neutral gas reaction device 2. Therefore, the process of Electron Transfer Dissociation (and/or Proton Transfer Reaction) can be arranged to occur in a substantially continuous fashion as the focal point moves along or is translated along the length of the ion, guide, ion-ion reaction device or ion-neutral gas reaction device 2. Eventually, product or fragment ions resulting from the Electron Transfer Dissociation reaction are preferably arranged to emerge from the exit of the ion guide, ion-ion reaction device or ion-neutral gas reaction device 2 and may be onwardly transmitted, for example, to a Time of Flight mass analyser. To enhance the overall sensitivity of the system, the timing of the release of ions from the ion guide, ion-ion reaction device or ion-neutral gas reaction device 2 may be synchronised with the pusher electrode of an orthogonal acceleration Time of Flight mass analyser. Variations on this embodiment are also contemplated wherein multiple focal points may be provided along the length of the ion guide, ion-ion reaction device or ion-neutral gas reaction device 2 and wherein optionally some or all of the focal points are translated along the length of the ion guide, ion-ion reaction device or ion-neutral gas reaction device 2.

According to an embodiment analyte cations and reagent anions which are input into the preferred ion guide, ion-ion reaction device or ion-neutral gas reaction device 2 may be generated from separate or distinct ion sources. In order to efficiently introduce both cations and anions from separate ion sources into an ion guide, ion-ion reaction device or ion-neutral gas reaction device 2 according to the preferred embodiment a further ion guide may be provided upstream (and/or downstream) of the preferred ion guide, ion-ion reaction device or ion-neutral gas reaction device 2. The further ion guide may be arranged to simultaneously and continuously receive and transfer ions of both polarities from separate ion sources at different locations and to direct both the analyte and reagent ions into the preferred ion guide, ion-ion reaction device or ion-neutral gas reaction device 2.

Figure 7:
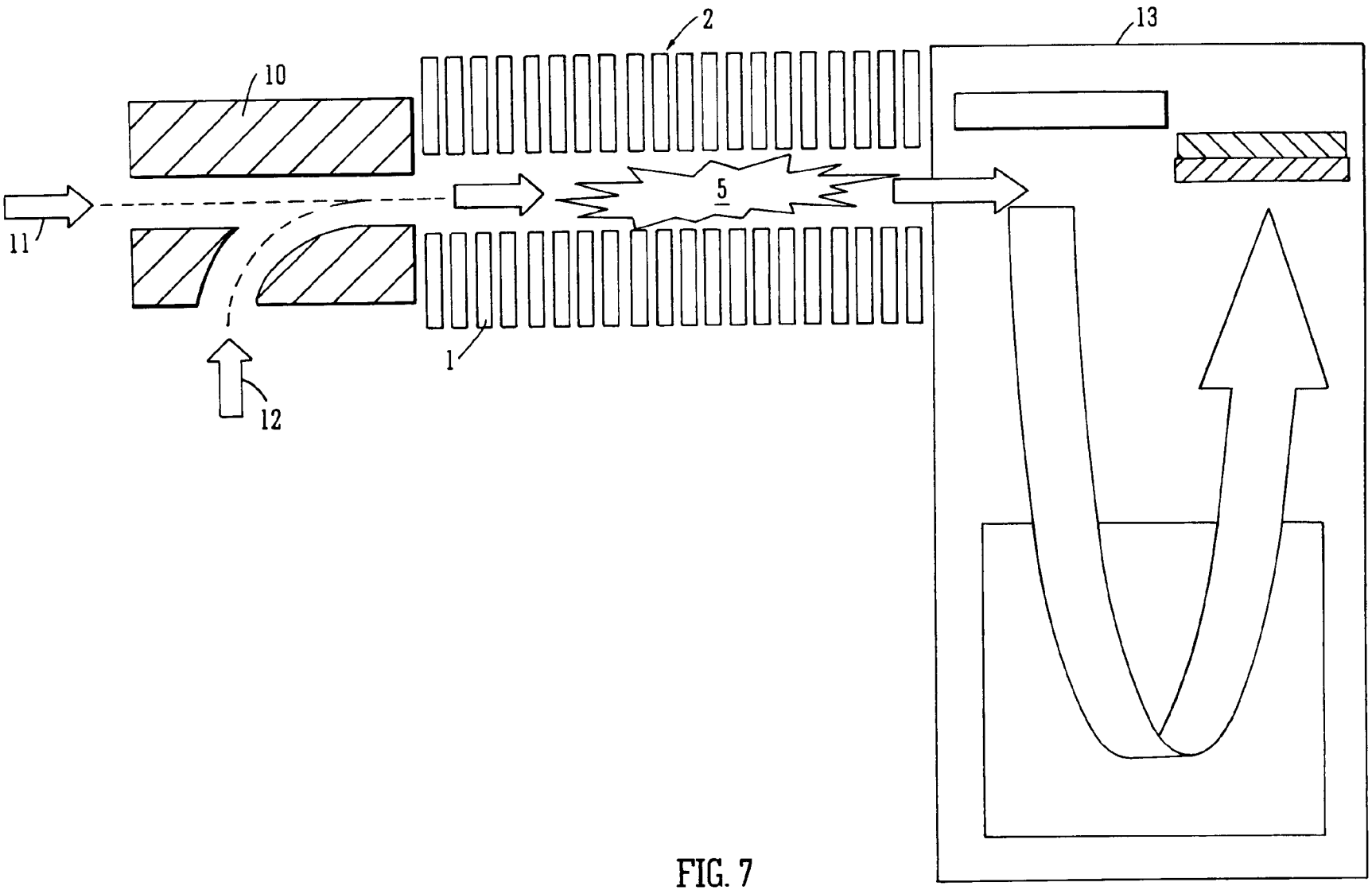
FIG. 7 shows an embodiment of the present invention wherein an ion guide coupler is provided upstream of a preferred ion guide, ion-ion reaction device or ion-neutral gas reaction device so that analyte and reagent ions can be directed into the preferred ion guide, ion-ion reaction device or ion-neutral gas reaction device and wherein the preferred ion guide, ion-ion reaction device or ion-neutral gas reaction device is coupled to an orthogonal acceleration Time of Flight mass analyser.

FIG. 7 illustrates an embodiment wherein an ion guide coupler 10 may be used to introduce both analyte cations 11 and reagent anions 12 into a preferred ion guide, ion-ion reaction device or ion-neutral gas reaction device 2 in order to form product or fragment ions by Electron Transfer Dissociation in the ion guide, ion-ion reaction device or ion-neutral gas reaction device 2. The ion guide coupler 10 may comprise a multiple plate RF ion guide such as is disclosed, for example, in U.S. Pat. No. 6,891,157. The ion guide coupler 10 may comprise a plurality of planar electrodes arranged generally in the plane of ion transmission. Adjacent planar electrodes are preferably maintained at opposite phases of an AC or RF potential. The planar electrodes are also preferably shaped so that ion guiding regions are formed within the ion guide coupler 10. Upper and/or lower planar electrodes may be provided and DC and/or RF voltages may be applied to the upper and/or lower planar electrodes in order to retain ions within the ion guide coupler 10.

One or more mass selective quadrupoles may also be utilized to select particular analyte and/or reagent ions received from the ion source(s) and to transmit only desired ions onwardly to the ion guide coupler 10. A Time of Flight mass analyser 11 may be arranged downstream of the preferred ion guide, ion-ion reaction device or ion-neutral gas reaction device 2 in order to receive and analyse product or fragment ions which are created in a reaction region 5 within the ion guide, ion-ion reaction device or ion-neutral gas reaction device 2 and which subsequently emerge from the ion guide, ion-ion reaction device or ion-neutral gas reaction device 2.

Experiments including applying travelling DC voltage waves to the electrodes of a stacked ring RF ion guide have shown that increasing the amplitude of the travelling DC wave voltage pulses and/or increasing the speed of the travelling DC wave voltage pulses within the ion reaction volume can cause the ion-ion reaction rates to be reduced or even stopped when necessary. This is due to the fact that the travelling DC voltage wave can cause a localised increase in the relative velocity of analyte cations relative to reagent anions. The ion-ion reaction rate has been shown to be inversely proportional to the cube of the relative velocity between cations and anions.

Increasing the amplitude and/or the speed of the travelling DC voltage wave may also cause cations and anions to spend less time together in the ion guide, ion-ion reaction device or ion-neutral gas reaction device 2 and hence may have the effect of reducing the reaction efficiency.

Figure 8A:
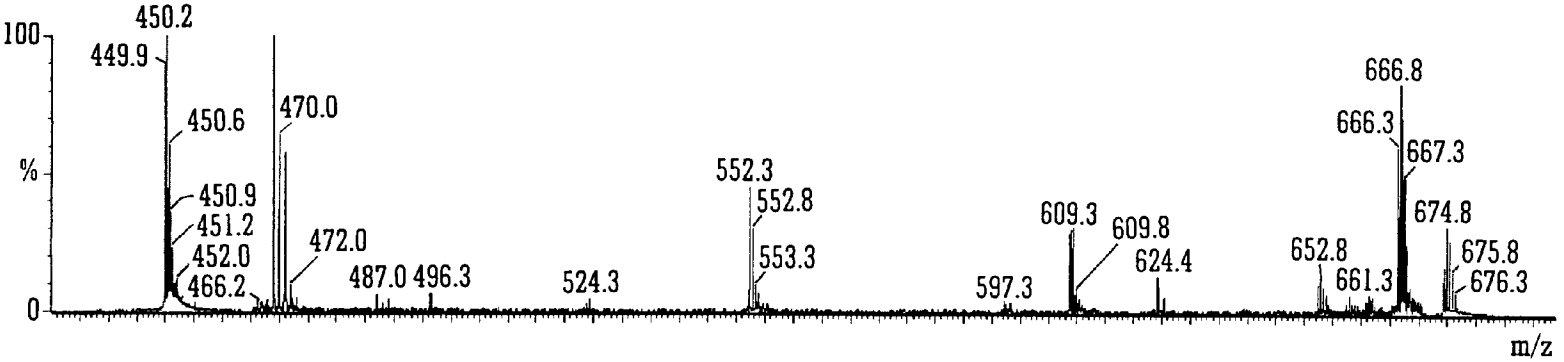
FIG. 8A shows a mass spectrum obtained when a travelling wave voltage having an amplitude of 0V was applied to the electrodes of a preferred ion guide, ion-ion reaction device or ion-neutral gas reaction device.
Figure 8B:
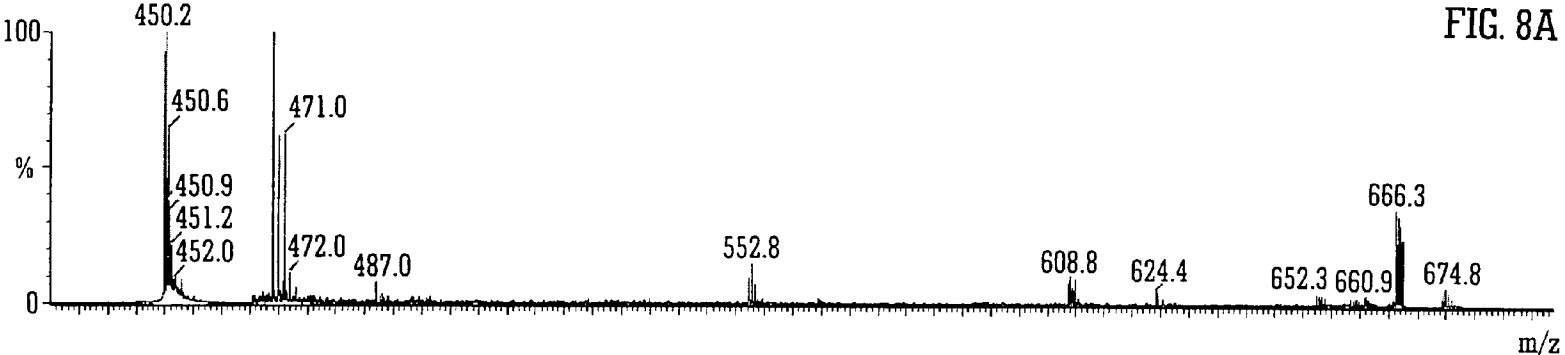
FIG. 8B shows a corresponding mass spectrum which was obtained when a travelling wave voltage having an amplitude of 0.5V was applied to the electrodes of the ion guide, ion-ion reaction device or ion-neutral gas reaction device.
Figure 8C:
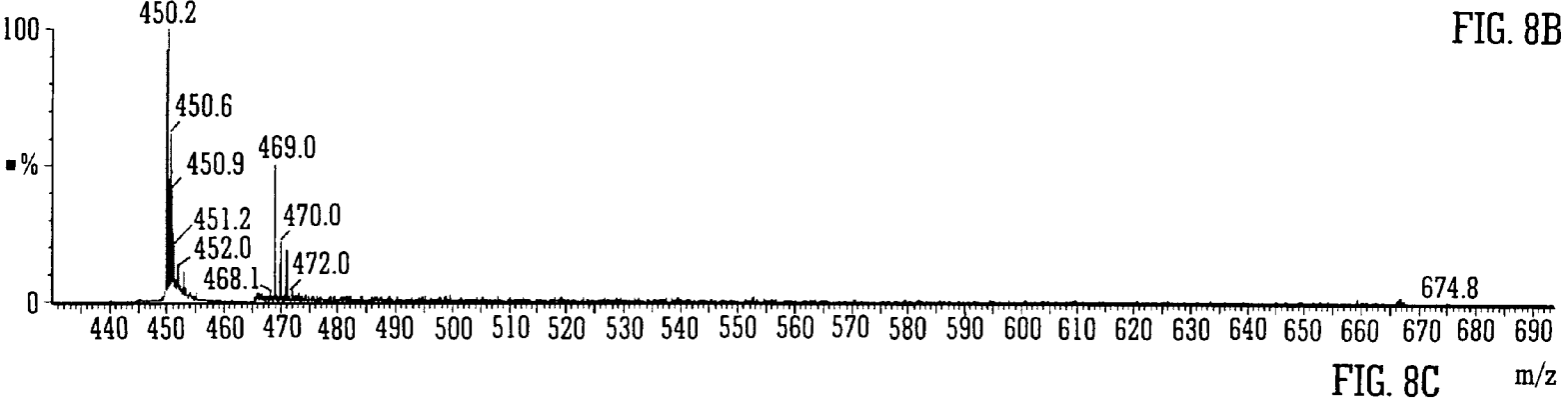
FIG. 8C shows a mass spectrum obtained when the travelling wave voltage applied to the electrodes of the ion guide, ion-ion reaction device or ion-neutral gas reaction device was increased to 1V.

FIGS. 8A-8C illustrate the effect of varying the amplitude of the travelling DC voltage wave on the generation or formation of Electron Transfer Dissociation product or fragment ions generated within the gas cell of a hybrid quadrupole Time of Flight mass spectrometer. In particular, FIGS. 8A-8C show the Electron Transfer Dissociation product or fragment ions resulting from fragmenting triply charge precursor cations of substance-P having a mass to charge ratio of 449.9 following ion-ion reaction with Azobenzene reagent anions. FIG. 8A shows a mass spectrum recorded when the travelling wave amplitude was set to 0 V, FIG. 8B shows a mass spectrum recorded when the travelling wave amplitude was set to 0.5 V and FIG. 8C shows a mass spectrum recorded when the travelling wave amplitude was increased to 1.0 V. It can be seen that the abundance of Electron Transfer Dissociation product or fragment ions is significantly reduced when a 1.0 V travelling wave is applied to the ion guide. This effect can be used to substantially prevent or quench the generation of Electron Transfer Dissociation fragment or product ions when so desired (and charge state reduction by Proton Transfer Reaction).

According to an embodiment of the present invention ion-ion reactions may be controlled or optimised by varying the amplitude and/or the speed of one or more DC travelling waves applied to the electrodes 1 of the ion guide, ion-ion reaction device or ion-neutral gas reaction device 2. However, other embodiments are contemplated wherein instead of controlling the amplitude of the travelling DC wave fields electronically, the field amplitudes may be controlled mechanically by utilising stack ring electrodes that vary in internal diameter or axial spacing. If the aperture of the ring stack or ring electrodes 1 are arranged to increase in diameter then the travelling wave amplitude experienced by ions will decrease assuming that the same amplitude voltage is applied to all electrodes 1.

Embodiments are contemplated wherein the amplitude of the one or more travelling DC voltage waves may be increased further and wherein the travelling DC voltage wave velocity is then reduced to zero so that a standing wave is effectively created. According to this embodiment ions in the reaction volume may be repeatedly accelerated and then decelerated along the axis of the ion guide, ion-ion reaction device or ion-neutral gas reaction device 2. This approach can be used to cause an increase in the internal energy of product or fragment ions so that the product or fragment ions may further decompose by the process of Collision Induced Dissociation (CID). This method of Collision Induced Dissociation is particularly useful in separating non-covalently bound product or fragment ions resulting from Electron Transfer Dissociation. Precursor ions that have previously been subjected to Electron Transfer Dissociation reactions often partially decompose (especially singly and doubly charged precursor ions) and the partially decomposed ions may remain non-covalently attached to each other.

According to another embodiment non-covalently bound product or fragment ions of interest may be separated from each other as they are being swept out from the stacked ring ion guide by the travelling DC wave operating in its normal mode of transporting ions. This may be achieved by setting the velocity of the travelling wave ion guide to a sufficiently high value such that ion-molecule collisions occur and induce the non-covalently bound fragment or product ions to separate.

Figure 9:
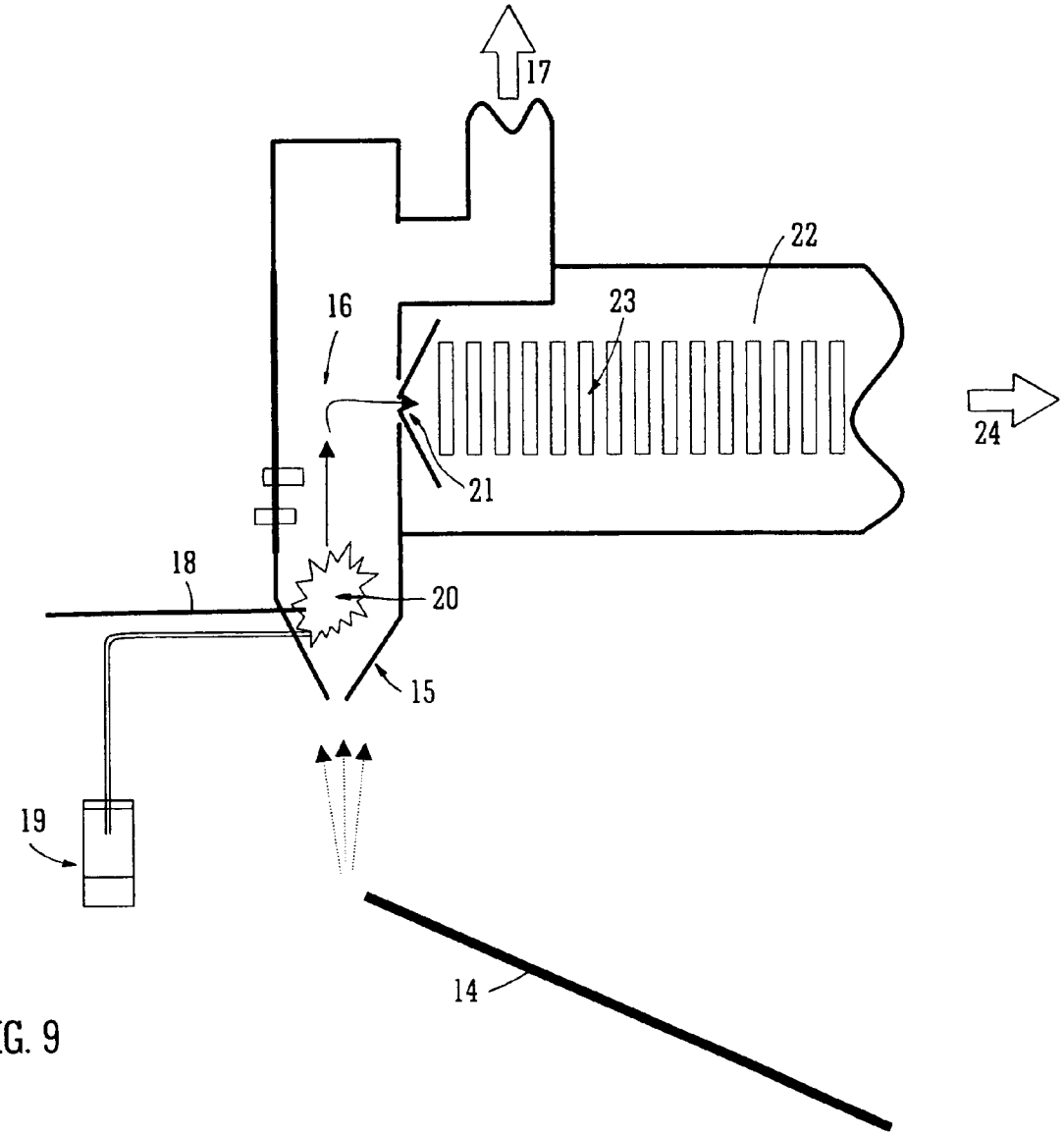
FIG. 9 shows an ion source section of a mass spectrometer according to an embodiment of the present invention wherein an Electrospray ion source is used to generate analyte ions and wherein reagent ions are generated in a glow discharge region located in an input vacuum chamber of the mass spectrometer.

According to another embodiment of the present invention analyte ions and reagent ions may be generated either by the same ion source or by a common ion generating section or stage of a mass spectrometer. For example, according to an embodiment analyte ions may be generated by an Electrospray ion source and reagent ions may be generated in a glow discharge region which is preferably arranged downstream of the Electrospray ion source. FIG. 9 shows an embodiment of the present invention wherein analyte ions are produced by an Electrospray ion source. The capillary of the Electrospray ion source is preferably maintained at +3 kV. The analyte ions are preferably drawn towards a sample cone 15 of a mass spectrometer which is preferably maintained at 0V. Ions preferably pass through the sample cone 15 and into a vacuum chamber 16 which is preferably pumped by a vacuum pump 17. A glow discharge pin 18 which is preferably connected to a high voltage source is preferably located close to and downstream of the sample cone 15 within the vacuum chamber 16. The glow discharge pin 18 may according to one embodiment be maintained at −750V. Reagent from a reagent source 19 is preferably bled or otherwise fed into the vacuum chamber 16 at a location close to the glow discharge pin 18. As a result, reagent ions are preferably created within the vacuum chamber 16 in a glow discharge region 20. The reagent ions are then preferably drawn through an extraction cone 21 and pass into a further downstream vacuum chamber 22. An ion guide 23 is preferably located in the further vacuum chamber 22. The reagent ions are then preferably onwardly transmitted to further stages 24 of the mass spectrometer and are preferably transmitted to a preferred ion guide, ion-ion reaction device or ion-neutral gas reaction device 2 which is preferably used as an Electron Transfer Dissociation and/or Proton Transfer Reaction device.

According to an embodiment of the present invention a dual mode or dual ion source may be provided. For example, according to an embodiment an Electrospray ion source may be used to generate analyte (or reagent) ions and an Atmospheric Pressure Chemical Ionisation ion source may be used to generate reagent (or analyte) ions. Negatively charged reagent ions may be passed into a reaction device by means of one or more travelling DC voltages or transient DC voltages which are applied to the electrodes of the reaction device. A negative DC potential may be applied to the reaction device in order to retain the negatively charged reagent ions within the reaction device. Positively charged analyte ions may then be input into the reaction device by applying one or more travelling DC voltage or transient DC voltages to the electrodes of the reaction device. The positively charged analyte ions are preferably not retained or prevented from exiting the reaction device. The various parameters of the travelling DC voltage or transient DC voltages applied to the electrodes of the reaction device may be optimised in order to optimise the degree of fragmentation by Electron Transfer Dissociation and/or charge state reduction of the analyte ions and/or product or fragment ions by Proton Transfer Reaction.

If a Glow Discharge ion source is used to generate reagent ions and/or analyte ions then the pin electrode of the ion source may, according to one embodiment, be maintained at a potential of ±500-700 V. According to an embodiment the potential of an ion source may be switched relatively rapidly between a positive potential (in order to generate cations) and a negative potential (in order to generate anions).

If a dual mode or dual ion source is provided, then it is contemplated that the ion source may be switched between modes or that the ion sources may be switched between each other approximately every 50 ms. Other embodiments are contemplated wherein the ion source may be switched between modes or the ion sources may be switched between each other on a timescale of <1 ms, 1-10 ms, 10-20 ms, 20-30 ms, 30-40 ms, 40-50 ms, 50-60 ms, 60-70 ms, 70-80 ms, 80-90 ms, 90-100 ms, 100-200 ms, 200-300 ms, 300-400 ms, 400-500 ms, 500-600 ms, 600-700 ms, 700-800 ms, 800-900 ms, 900-1000 ms, 1-2 s, 2-3 s, 3-4 s, 4-5 s or >5 s. Other embodiments are contemplated wherein instead of switching one or more ions sources ON and OFF, the one or more ion sources may instead be left substantially ON. According to this embodiment an ion source selector device such as a baffle or rotating ion beam block may be used. For example, two ion sources may be left ON but the ion beam selector preferably only allows ions from one of the ion sources to be transmitted to the mass spectrometer at any particular instant in time. Yet further embodiments are contemplated wherein on ion source may be left ON and another ion source may be switched repeatedly ON and OFF.

According to an embodiment Electron Transfer Dissociation fragmentation (and/or Proton Transfer Reaction charge state reduction) may be controlled, enhanced or substantially prevented by controlling the velocity of the travelling DC voltages applied to the electrodes. If the travelling DC voltages are applied to the electrodes in a very rapid manner then very few analyte ions may fragment by means of Electron Transfer Dissociation (and/or charge state reduction by Proton Transfer Reaction may be substantially reduced).

Although various embodiments have been discussed wherein the reaction volume has been optimised towards the centre of the reaction device, other embodiments are contemplated wherein the reaction device may be optimised towards e.g. the upstream and/or downstream end of the reaction device. For example, the internal diameter of the ring electrodes may progressively increase or decrease towards the downstream end of the reaction device. Additionally or alternatively the pitch of the ring electrodes may progressively decrease or increase towards the downstream end of the reaction device.

A less preferred embodiment is also contemplated wherein gas flow dynamic effects and/or pressure differential effects may be used in order to urge or force analyte and/or reagent ions through portions of the reaction device. Gas flow dynamic effects may be used in addition to other ways or means of driving or urging ions along and through the preferred reaction device.

Ions emerging from the reaction device may be subjected to ion mobility separation in a separate ion mobility separation cell or stage which is preferably arranged downstream and/or upstream of the reaction device.

It is contemplated that the charge state of analyte ions may be reduced by Proton Transfer Reaction prior to the analyte ions interacting with reagent ions and/or neutral reagent gas. Additionally or alternatively, the charge state of product or fragment ions resulting from Electron Transfer Dissociation may be reduced by Proton Transfer Reaction.

It is also contemplated that analyte ions may be fragmented or otherwise caused to dissociate by transferring protons to reagent ions or neutral reagent gas.

Product or fragment ions which result from Electron Transfer Dissociation may non-covalently bond together. Embodiments of the present invention are contemplated wherein non-covalently bonded product or fragment ions are fragmented by Collision Induced Dissociation, Surface Induced Dissociation or other fragmentation processes either in the same reaction device in which Electron Transfer Dissociation was performed or in a separate reaction device or cell.

Further embodiments are contemplated wherein analyte ions may be caused to fragment or dissociate following reactions or interactions with metastable atoms or ions such as atoms or ions of xenon, caesium, helium or nitrogen.

According to another embodiment substantially the same reagent ions which are disclosed above as being suitable for use for Electron Transfer Dissociation may additionally or alternatively be used for Proton Transfer Reaction. So for example, according to an embodiment reagent anions or negatively charged ions derived from a polyaromatic hydrocarbon or a substituted polyaromatic hydrocarbon may be used to initiate Proton Transfer Reaction. Similarly, reagent anions or negatively charged ions for use in Proton Transfer Reaction may be derived from substances selected from the group consisting of: (i) anthracene; (ii) 9,10 diphenyl-anthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone. Reagent ions or negatively charged ions comprising azobenzene anions, azobenzene radical anions or other radical anions may also be used to perform Proton Transfer Reaction.

According to an embodiment neutral helium gas may be provided to the reaction device at a pressure in the range 0.01-0.1 mbar, less preferably 0.001-1 mbar. Helium gas has been found to be particularly useful in supporting Electron Transfer Dissociation and/or Proton Transfer. Reaction in the reaction device. Nitrogen and argon gas are less preferred and may cause at least some ions to fragment by Collision Induced Dissociation rather than by Electron Transfer Dissociation.

Embodiments are also contemplated wherein a dual mode ion source may be switched between modes or two ion sources may be switched ON/OFF in a symmetric or asymmetric manner. For example, according to an embodiment an ion source producing analyte ions may be left ON for approximately 90% of a duty cycle. For the remaining 10% of the duty cycle the ion source producing analyte ions may be switched OFF and reagent ions may be produced in order to replenish the reagent ions within the preferred reaction device. Other embodiments are contemplated wherein the ratio of the period of time during which the ion source generating analyte ions is switched ON (or analyte ions are transmitted into the mass spectrometer) relative to the period of time during which the ion source generating reagent ions is switched ON (or reagent ions are transmitted into the mass spectrometer or generated within the mass spectrometer) may fall within the range <1, 1-2, 2-3, 3-4, 4-5, 5-6, 6-7, 7-8, 8-9, 9-10, 10-15, 15-20, 20-25, 25-30, 30-35, 35-40, 40-45, 45-50 or >50.

Although the present invention has been described with reference to preferred embodiments, it will be understood by those skilled in the art that various changes in form and detail may be made without departing from the scope of the invention as set forth in the accompanying claims.

The invention claimed is:

1. An Electron Transfer Dissociation or Proton Transfer Reaction device comprising:

an ion guide comprising a plurality of electrodes each having at least one aperture, wherein ions are transmitted in use through said apertures; and a first device arranged and adapted to apply one or more first transient DC voltages or potentials or one or more first transient DC voltage or potential waveforms to at least some of said plurality of electrodes in order to drive or urge at least some first ions along or through at least a portion of the axial length of said ion guide in a first direction;

wherein said first ions are caused to react with:

(i) second ions already present within said ion guide; or (ii) second ions which are subsequently added to or provided into said ion guide; and wherein said first device is arranged and adapted to apply one or more second transient DC voltages or potentials or one or more second transient DC voltage or potential waveforms to at least some of said plurality of electrodes in order to drive or urge at least some second ions along or through at least a portion of the axial length of said ion guide in a second direction wherein said second direction is either substantially the same or substantially different to said first direction.

2. An Electron Transfer Dissociation or Proton Transfer Reaction device as claimed in claim 1, wherein said first ions are caused to remain within said ion guide.

3. An Electron Transfer Dissociation or Proton Transfer Reaction device as claimed in claim 1, wherein said first device is arranged and adapted to apply said one or more first transient DC voltages or potentials or said one or more first transient DC voltage or potential waveforms to 0-5%, 5-10%, 10-15%, 15-20%, 20-25%, 25-30%, 30-35%, 35-40%, 40-45%, 45-50%, 50-55%, 55-60%, 60-65%, 65-70%, 70-75%, 75-80%, 80-85%, 85-90%, 90-95% or 95-100% of said plurality of electrodes in order to drive or urge at least some said first ions along or through at least 0-5%, 5-10%, 10-15%, 15-20%, 20-25%, 25-30%, 30-35%, 35-40%, 40-45%, 45-50%, 50-55%, 55-60%, 60-65%, 65-70%, 70-75%, 75-80%, 80-85%, 85-90%, 90-95% or 95-100% of the axial length of said ion guide, and wherein said first device is arranged and adapted to apply said one or more second transient DC voltages or potentials or said one or more second transient DC voltage or potential waveforms to 0-5%, 5-10%, 10-15%, 15-20%, 20-25%, 25-30%, 30-35%, 35-40%, 40-45%, 45-50%, 50-55%, 55-60%, 60-65%, 65-70%, 70-75%, 75-80%, 80-85%, 85-90%, 90-95% or 95-100% of said plurality of electrodes in order to drive or urge at least some said second ions along or through at least 0-5%, 5-10%, 10-15%, 15-20%, 20-25%, 25-30%, 30-35%, 35-40%, 40-45%, 45-50%, 50-55%, 55-60%, 60-65%, 65-70%, 70-75%, 75-80%, 80-85%, 85-90%, 90-95% or 95-100% of the axial length of said ion guide.

4. An Electron Transfer Dissociation or Proton Transfer Reaction device as claimed in claim 1, further comprising:

(a) a device arranged and adapted to progressively increase, progressively decrease, progressively vary, scan, linearly increase, linearly decrease, increase in a stepped, or decrease in a stepped the amplitude, height or depth of said one or more first transient DC voltages or potentials or said one or more first transient DC voltage or potential waveforms by $x_3$ over a time period $t_3$;

wherein $x_3$ is selected from the group consisting of: (i) <0.1 V; (ii) 0.1-0.2 V; (iii) 0.2-0.3 V; (iv) 0.3-0.4 V; (v) 0.4-0.5 V; (vi) 0.5-0.6 V; (vii) 0.6-0.7 V; (viii) 0.7-0.8 V; (ix) 0.8-0.9 V; (x) 0.9-1.0 V; (xi) 1.0-1.5 V; (xii) 1.5-2.0 V; (xiii) 2.0-2.5 V; (xiv) 2.5-3.0 V; (xv) 3.0-3.5 V; (xvi) 3.5-4.0 V; (xvii) 4.0-4.5 V; (xviii) 4.5-5.0 V; (xix) 5.0-5.5 V; (xx) 5.5-6.0 V; (xxi) 6.0-6.5 V; (xxii) 6.5-7.0 V; (xxiii) 7.0-7.5 V; (xxiv) 7.5-8.0 V; (xxv) 8.0-8.5 V; (xxvi) 8.5-9.0 V; (xxvii) 9.0-9.5 V; (xxviii) 9.5-10.0 V; and (xxix) > 10.0 V; and wherein $t_3$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s; and (b) a device arranged and adapted to progressively increase, progressively decrease, progressively vary, scan, linearly increase, linearly decrease, increase in a stepped, or decrease in a stepped the amplitude, height or depth of said one or more second transient DC voltages or potentials or said one or more second transient DC voltage or potential waveforms by $x_5$ over a time period $t_5$;

wherein $x_5$ is selected from the group consisting of: (i) <0.1 V; (ii) 0.1-0.2 V; (iii) 0.2-0.3 V; (iv) 0.3-0.4 V; (v) 0.4-0.5 V; (vi) 0.5-0.6 V; (vii) 0.6-0.7 V; (viii) 0.7-0.8 V; (ix) 0.8-0.9 V; (x) 0.9-1.0 V; (xi) 1.0-1.5 V; (xii) 1.5-2.0 V; (xiii) 2.0-2.5 V; (xiv) 2.5-3.0 V; (xv) 3.0-3.5 V; (xvi) 3.5-4.0 V; (xvii) 4.0-4.5 V; (xviii) 4.5-5.0 V; (xix) 5.0-5.5 V; (xx) 5.5-6.0 V; (xxi) 6.0-6.5 V; (xxii) 6.5-7.0 V; (xxiii) 7.0-7.5 V; (xxiv) 7.5-8.0 V; (xxv) 8.0-8.5 V; (xxvi) 8.5-9.0 V; (xxvii) 9.0-9.5 V; (xxviii) 9.5-10.0 V; and (xxix) > 10.0 V; and wherein $t_5$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

5. An Electron Transfer Dissociation or Proton Transfer Reaction device as claimed in claim 1, further comprising:

(a) a device arranged and adapted to progressively increase, progressively decrease, progressively vary, scan, linearly increase, linearly decrease, increase in a stepped, or decrease in a stepped the velocity or rate at which said one or more first transient DC voltages or potentials or said one or more first transient DC voltage or potential waveforms are applied to or translated along said electrodes by $x_4$ m/s over a time period $t_4$;

wherein $x_4$ is selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10; (xi) 10-11; (xii) 11-12; (xiii) 12-13; (xiv) 13-14; (xv) 14-15; (xvi) 15-16; (xvii) 16-17; (xviii) 17-18; (xix) 18-19; (xx) 19-20; (xxi) 20-30; (xxii) 30-40; (xxiii) 40-50; (xxiv) 50-60; (xxv) 60-70; (xxvi) 70-80; (xxvii) 80-90; (xxviii) 90-100; (xxix) 100-150; (xxx) 150-200; (xxxi) 200-250; (xxxii) 250-300; (xxxiii) 300-350; (xxxiv) 350-400; (xxxv) 400-450; (xxxvi) 450-500; (xxxvii) 500-600; (xxxviii) 600-700; (xxxix) 700-800; (xl) 800-900; (xli) 900-1000; (xlii) 1000-2000; (xliii) 2000-3000; (xliv) 3000-4000; (xlv) 4000-5000; (xlvi) 5000-6000; (xlvii) 6000-7000; (xlviii) 7000-8000; (xlix) 8000-9000; (l) 9000-10000; and (li) >10000 and wherein $t_4$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s; and (b) a device arranged and adapted to progressively increase, progressively decrease, progressively vary, scan, linearly increase, linearly decrease, increase in a stepped, or decrease in a stepped the velocity or rate at which said one or more second transient DC voltages or potentials or said one or more second transient DC voltage or potential waveforms are applied to or translated alone said electrodes by $x_6$ m/s over a time period $t_6$, wherein $x_6$ is selected from the group consisting of: (i) <1; ii) 1-2; (iii) 2-3; (iv) 3-4; (v) 4-5; (vi) 5-6; (vii) 6-7; (viii) 7-8; (ix) 8-9; (x) 9-10; (xi) 10-11; (xii) 11-12; (xiii) 12-13; (xiv) 13-14; (xv) 14-15; (xvi) 15-16; (xvii) 16-17; (xviii) 17-18; (xix) 18-19; (xx) 19-20; (xxi) 20-30; (xxii) 30-40; (xxiii) 40-50; (xxiv) 50-60; (xxv) 60-70; (xxvi) 70-80; (xxvii) 80-90; (xxviii) 90-100; (xxix) 100-150; (xxx) 150-200; (xxxi) 200-250; (xxxii) 250-300; (xxxiii) 300-350; (xxxiv) 350-400; (xxxv) 400-450; (xxxvi) 450-500; (xxxvii) 500-600; (xxxviii) 600-700; (xxxix) 700-800; (xl) 800-900; (xli) 900-1000; (xlii) 1000-2000; (xliii) 2000-3000; (xliv) 3000-4000; (xlv) 4000-5000; (xlvi) 5000-6000; (xlvii) 6000-7000; (xlviii) 7000-8000; (xlix) 8000-9000; (l) 9000-10000; and (li) >10000; and wherein $t_6$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

6. An Electron Transfer Dissociation or Proton Transfer Reaction device as claimed in claim 1, wherein said first ions comprise:

(i) anions or negatively charged ions;

(ii) cations or positively charged ions; or (iii) a combination or mixture of anions and cations; and wherein said second ions comprise:

(i) anions or negatively charged ions;

(ii) cations or positively charged ions; or (iii) a combination or mixture of anions and cations.

7. An Electron Transfer Dissociation or Proton Transfer Reaction device as claimed in claim 1, further comprising a first RF device arranged and adapted to apply a first AC or RF voltage having a first frequency and a first amplitude to at least some of said plurality of electrodes such that, in use, ions are confined radially within said ion guide, wherein:

(a) said first frequency is selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz; and (b) said first amplitude is selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak; and (c) in a mode of operation adjacent or neighbouring electrodes are supplied with opposite phase of said first AC or RF voltage; and (d) said ion guide comprises 1-10, 10-20, 20-30, 30-40, 40-50, 50-60, 60-70, 70-80, 80-90, 90-100 or >100 groups of electrodes, wherein each group of electrodes comprises at least 1, 2, 3, 4, 5, 6, 7, 8, 9, 10, 11, 12, 13, 14, 15, 16, 17, 18, 19 or 20 electrodes and wherein at least 1, 2, 3, 4, 5, 6, 7, 8, 9, 10, 11, 12, 13, 14, 15, 16, 17, 18, 19 or 20 electrodes in each group are supplied with the same phase of said first AC or RF voltage.

8. An Electron Transfer Dissociation or Proton Transfer Reaction device as claimed in claim 7, further comprising:

(a) a device arranged and adapted to progressively increase, progressively decrease, progressively vary, scan, linearly increase, linearly decrease, increase in a stepped, or decrease in a stepped said first frequency by $x_1$ over a time period $t_1$, wherein $x_1$ is selected from the group consisting of: (i) < 100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz; and wherein $t_1$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv)>5 s.

9. An Electron Transfer Dissociation or Proton Transfer Reaction device as claimed in claim 1, wherein either:

(a) at least 1%, 5%, 10%, 20%, 30%, 40%, 50%, 60%, 70%, 80%, 90%, 95% or 100% of said electrodes have substantially circular, rectangular, square or elliptical apertures; or (b) at least 1%, 5%, 10%, 20%, 30%, 40%, 50%, 60%, 70%, 80%, 90%, 95% or 100% of said electrodes have apertures which are substantially the same first size or which have substantially the same first area and at least 1%, 5%, 10%, 20%, 30%, 40%, 50%, 60%, 70%, 80%, 90%, 95% or 100% of said electrodes have apertures which are substantially the same second different size or which have substantially the same second different area; or (c) at least 1%, 5%, 10%, 20%, 30%, 40%, 50%, 60%, 70%, 80%, 90%, 95% or 100% of said electrodes have apertures which become progressively larger or smaller in size or in area in a direction along the axis of said ion guide; or (d) at least 1%, 5%, 10%, 20%, 30%, 40%, 50%, 60%, 70%, 80%, 90%, 95% or 100% of said electrodes have apertures having internal diameters or dimensions selected from the group consisting of: (i) ≦1.0 mm; (ii) ≦2.0 mm; (iii) ≦3.0 mm; (iv) ≦4.0 mm; (v) ≦5.0 mm; (vi) ≦6.0 mm; (vii) ≦7.0 mm; (viii) ≦8.0 mm; (ix) ≦9.0 mm; (x) ≦10.0 mm; and (xi) >10.0 mm; or (e) at least 1%, 5%, 10%, 20%, 30%, 40%, 50%, 60%, 70%, 80%, 90%, 95% or 100% of said electrodes are spaced apart from one another by an axial distance selected from the group consisting of: (i) less than or equal to 5 mm; (ii) less than or equal to 4.5 mm; (iii) less than or equal to 4 mm; (iv) less than or equal to 3.5 mm; (v) less than or equal to 3 mm; (vi) less than or equal to 2.5 mm; (vii) less than or equal to 2 mm; (viii) less than or equal to 1.5 mm; (ix) less than or equal to 1 mm; (x) less than or equal to 0.8 mm; (xi) less than or equal to 0.6 mm; (xii) less than or equal to 0.4 mm; (xiii) less than or equal to 0.2 mm; (xiv) less than or equal to 0.1 mm; and (xv) less than or equal to 0.25 mm; or (f) at least some of said plurality of electrodes comprise apertures and wherein the ratio of the internal diameter or dimension of said apertures to the center-to-center axial spacing between adjacent electrodes is selected from the group consisting of: (i) <1.0; (ii) 1.0-1.2; (iii) 1.2-1.4; (iv) 1.4-1.6; (v) 1.6-1.8; (vi) 1.8-2.0; (vii) 2.0-2.2; (viii) 2.2-2.4; (ix) 2.4-2.6; (x) 2.6-2.8; (xi) 2.8-3.0; (xii) 3.0-3.2; (xiii) 3.2-3.4; (xiv) 3.4-3.6; (xv) 3.6-3.8; (xvi) 3.8-4.0; (xvii) 4.0-4.2; (xviii) 4.2-4.4; (xix) 4.4-4.6; (xx) 4.6-4.8; (xxi) 4.8-5.0; and (xxii) >5.0; or (g) the internal diameter of the apertures of said plurality of electrodes progressively increases or decreases and then progressively decreases or increases one or more times along the longitudinal axis of said ion guide; or (h) said plurality of electrodes define a geometric volume, wherein said geometric volume is selected from the group consisting of: (i) one or more spheres; (ii) one or more oblate spheroids; (iii) one or more prolate spheroids; (iv) one or more ellipsoids; and (v) one or more scalene ellipsoids; or (i) said ion guide has a length selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; and (xi) >200 mm; or (j) said ion guide comprises at least: (i) 1-10 electrodes; (ii) 10-20 electrodes; (iii) 20-30 electrodes; (iv) 30-40 electrodes; (v) 40-50 electrodes; (vi) 50-60 electrodes; (vii) 60-70 electrodes; (viii) 70-80 electrodes; (ix) 80-90 electrodes; (x) 90-100 electrodes; (xi) 100-110 electrodes; (xii) 110-120 electrodes; (xiii) 120-130 electrodes; (xiv) 130-140 electrodes; (xv) 140-150 electrodes; (xvi) 150-160 electrodes; (xvii) 160-170 electrodes; (xviii) 170-180 electrodes; (xix) 180-190 electrodes; (xx) 190-200 electrodes; and (xxi) >200 electrodes; or (k) at least 1%, 5%, 10%, 20%, 30%, 40%, 50%, 60%, 70%, 80%, 90%, 95% or 100% of said electrodes have a thickness or axial length selected from the group consisting of: (i) less than or equal to 5 mm; (ii) less than or equal to 4.5 mm; (iii) less than or equal to 4 mm; (iv) less than or equal to 3.5 mm; (v) less than or equal to 3 mm; (vi) less than or equal to 2.5 mm; (vii) less than or equal to 2 mm; (viii) less than or equal to 1.5 mm; (ix) less than or equal to 1 mm; (x) less than or equal to 0.8 mm; (xi) less than or equal to 0.6 mm; (xii) less than or equal to 0.4 mm; (xiii) less than or equal to 0.2 mm; (xiv) less than or equal to 0.1 mm; and (xv) less than or equal to 0.25 mm; and/or (l) the pitch or axial spacing of said plurality of electrodes progressively decreases or increases one or more times along the longitudinal axis of said ion guide.

10. An Electron Transfer Dissociation or Proton Transfer Reaction device as claimed in claim 1, wherein:

(a) in a mode of operation said one or more first transient DC voltages or potentials or said one or more first transient DC voltage or potential waveforms are subsequently applied to at least some of said plurality of electrodes in order to drive or urge at least some product or fragment ions along or through at least a portion of the axial length of said ion guide in a direction different or reverse to said first direction; and (b) in a mode of operation said one or more second transient DC voltage or potentials or one or more second transient DC voltage or potential waveforms are subsequently applied to at least some of said plurality of electrodes in order to drive or urge at least some product or fragment ions along or through at least a portion of the axial length of said ion guide in a direction different or reverse to said second direction.

11. An Electron Transfer Dissociation or Proton Transfer Reaction device as claimed in claim 1, further comprising a device arranged and adapted either:

(a) to maintain said ion guide in a mode of operation at a pressure selected from the group consisting of: (i) <100 mbar; (ii) <10 mbar; (iii) <1 mbar; (iv) <0.1 mbar; (v) < 0.01 mbar; (vi) <0.001 mbar; (vii) <0.0001 mbar; and (viii) <0.00001 mbar; or (b) to maintain said ion guide in a mode of operation at a pressure selected from the group consisting of: (i) >100 mbar; (ii) >10 mbar; (iii) >1 mbar; (iv) >0.1 mbar; (v) > 0.01 mbar; (vi) >0.001 mbar; and (vii) >0.0001 mbar; or (c) to maintain said ion guide in a mode of operation at a pressure selected from the group consisting of: (i) 0.0001-0.001 mbar; (ii) 0.001-0.01 mbar; (iii) 0.01-0.1 mbar; (iv) 0.1-1 mbar; (v) 1-10 mbar; (vi) 10-100 mbar; and (vii) 100-1000 mbar.

12. An Electron Transfer Dissociation or Proton Transfer Reaction device as claimed in claim 1, wherein:

(a) in a mode of operation ions are predominantly arranged to fragment by Collision Induced Dissociation to form product or fragment ions, wherein said product or fragment ions comprise a majority of b-type product or fragment ions and/or y-type product or fragment ions; or (b) in a mode of operation ions are predominantly arranged to fragment by Electron Transfer Dissociation to form product or fragment ions, wherein said product or fragment ions comprise a majority of c-type product or fragment ions and/or z-type product or fragment ions.

13. An Electron Transfer Dissociation or Proton Transfer Reaction device as claimed in claim 1, wherein in order to effect Electron Transfer Dissociation either:

(a) analyte ions are fragmented or are induced to dissociate and form product or fragment ions upon interacting with reagent ions; or (b) electrons are transferred from one or more reagent anions or negatively charged ions to one or more multiply charged analyte cations or positively charged ions whereupon at least some of said multiply charged analyte cations or positively charged ions are induced to dissociate and form product or fragment ions; or (c) analyte ions are fragmented or are induced to dissociate and form product or fragment ions upon interacting with neutral reagent gas molecules or atoms or a non-ionic reagent gas; or (d) electrons are transferred from one or more neutral, non-ionic or uncharged basic gases or vapours to one or more multiply charged analyte cations or positively charged ions whereupon at least some of said multiply charged analyte cations or positively charged ions are induced to dissociate and form product or fragment ions; or (e) electrons are transferred from one or more neutral, non-ionic or uncharged superbase reagent gases or vapours to one or more multiply charged analyte cations or positively charged ions whereupon at least some of said multiply charge analyte cations or positively charged ions are induced to dissociate and form product or fragment ions; or (f) electrons are transferred from one or more neutral, non-ionic or uncharged alkali metal gases or vapours to one or more multiply charged analyte cations or positively charged ions whereupon at least some of said multiply charged analyte cations or positively charged ions are induced to dissociate and form product or fragment ions; or (g) electrons are transferred from one or more neutral, non-ionic or uncharged gases, vapours or atoms to one or more multiply charged analyte cations or positively charged ions whereupon at least some of said multiply charged analyte cations or positively charged ions are induced to dissociate and form product or fragment ions, wherein said one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; or (viii) magnesium vapour or atoms; and wherein in order to effect Proton Transfer Reaction either:

(h) protons are transferred from one or more multiply charged analyte cations or positively charged ions to one or more reagent anions or negatively charged ions whereupon at least some of said multiply charged analyte cations or positively charged ions are reduced in charge state or are induced to dissociate and form product or fragment ions; or (i) protons are transferred from one or more multiply charged analyte cations or positively charged ions to one or more neutral, non-ionic or uncharged reagent gases or vapours whereupon at least some of said multiply charged analyte cations or positively charged ions are reduced in charge state or are induced to dissociate and form product or fragment ions.

14. An Electron Transfer Dissociation or Proton Transfer Reaction device as claimed in claim 13, wherein in order to effect Electron Transfer Dissociation:

(a) said reagent anions or negatively charged ions are derived from a polyaromatic hydrocarbon or a substituted polyaromatic hydrocarbon; or (b) said reagent anions or negatively charged ions are derived from the group consisting of: (i) anthracene; (ii) 9,10 diphenyl-anthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; or (c) said reagent ions or negatively charged ions comprise azobenzene anions or azobenzene radical anions; or wherein in order to effect Proton Transfer Reaction either:

(d) said reagent anions or negatively charged ions are derived from a compound selected from the group consisting of: (i) carboxylic acid; (ii) phenolic; and (iii) a compound containing alkoxide; or (e) said reagent anions or negatively charged ions are derived from a compound selected from the group consisting of: (i) benzoic acid; (ii) perfluoro-1,3-dimethylcyclohexane or PDCH; (iii) sulphur hexafluoride or SF6; and (iv) perfluorotributylamine or PFTBA; or (f) said one or more reagent gases or vapours comprise a superbase gas; or (g) said one or more reagent gases or vapours are selected from the group consisting of: (i) 1,1,3,3-Tetramethylguanidine ("TMG"); (ii) 2,3,4,6,7,8,9,10-Octahydropyrimidol[1,2-a]azepine {Synonym: 1,8-Diazabicyclo[5.4.0]undec-7-ene ("DBU")}; or (iii) 7-Methyl-1,5,7-triazabicyclo[4.4.0]dec-5-ene ("MTBD") {Synonym: 1,3,4,6,7,8-Hexahydro-1-methyl-2H-pyrimido[1,2-a]pyrimidine}.

15. An Electron Transfer Dissociation or Proton Transfer Reaction device as claimed in claim 13, wherein said multiply charged analyte cations or positively charged ions comprise peptides, polypeptides, proteins or biomolecules.

16. A mass spectrometer comprising an Electron Transfer Dissociation or Proton Transfer Reaction device as claimed in claim 1, said mass spectrometer further comprising one or more of:

(a) an ion source arranged upstream of said Electron Transfer Dissociation or Proton Transfer Reaction device, wherein said ion source is selected from the group consisting of: (i) an Electrospray Ionization ("ESI") ion source; (ii) an Atmospheric Pressure Photo Ionization ("APPI") ion source; (iii) an Atmospheric Pressure Chemical Ionization ("APCI") ion source; (iv) a Matrix Assisted Laser Desorption Ionization ("MALDI") ion source; (v) a Laser Desorption Ionization ("LDI") ion source; (vi) an Atmospheric Pressure Ionization ("API") ion source; (vii) a Desorption Ionization on Silicon ("DIOS") ion source; (viii) an Electron Impact ("EI") ion source; (ix) a Chemical Ionization ("CI") ion source; (x) a Field Ionization ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionization ("DESI") ion source; (xvi) a Nickel-63 radioactive ion source; (xvii) an Atmospheric Pressure Matrix Assisted Laser Desorption Ionization ion source; (xviii) a Thermospray ion source; (xix) an Atmospheric Sampling Glow Discharge Ionization ("ASGDI") ion source; and (xx) a Glow Discharge ("GD") ion source; and (b) one or more continuous or pulsed ion sources; and (c) one or more ion guides arranged downstream of said Electron Transfer Dissociation or Proton Transfer Reaction device; and (d) one or more ion mobility separation devices or one or more Field Asymmetric Ion Mobility Spectrometer devices arranged downstream of said Electron Transfer Dissociation or Proton Transfer Reaction device; and (e) one or more ion traps or one or more ion trapping regions arranged downstream of said Electron Transfer Dissociation or Proton Transfer Reaction device; and (f) one or more collision, fragmentation or reaction cells arranged downstream of said Electron Transfer Dissociation or Proton Transfer Reaction device, wherein said one or more collision, fragmentation or reaction cells are selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionization Dissociation ("EID") fragmentation device; and (g) a mass analyzer selected from the group consisting of: (i) a quadrupole mass analyzer; (ii) a 2D or linear quadrupole mass analyzer; (iii) a Paul or 3D quadrupole mass analyzer; (iv) a Penning trap mass analyzer; (v) an ion trap mass analyzer; (vi) a magnetic sector mass analyzer; (vii) Ion Cyclotron Resonance ("ICR") mass analyzer; (viii) a Fourier Transform Ion Cyclotron Resonance ("FTICR") mass analyzer; (ix) an electrostatic or orbitrap mass analyzer; (x) a Fourier Transform electrostatic or orbitrap mass analyzer; (xi) a Fourier Transform mass analyzer; (xii) a Time of Flight mass analyzer; (xiii) an orthogonal acceleration Time of Flight mass analyzer; and (xiv) a linear acceleration Time of Flight mass analyzer; and (h) one or more energy analyzers or electrostatic energy analyzers arranged downstream of said Electron Transfer Dissociation or Proton Transfer Reaction device; and (i) one or more ion detectors arranged downstream of said Electron Transfer Dissociation or Proton Transfer Reaction device; and (j) one or more mass filters arranged downstream of said Electron Transfer Dissociation or Proton Transfer Reaction device, wherein said one or more mass filters are selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wein filter; and (k) a device or ion gate for pulsing ions into said Electron Transfer Dissociation or Proton Transfer Reaction device; and (l) a device for converting a substantially continuous ion beam into a pulsed ion beam.

17. A mass spectrometer as claimed in claim 16, further comprising:

(a) one or more Atmospheric Pressure ion sources for generating analyte ions or reagent ions; or (b) one or more Electrospray ion sources for generating analyte ions or reagent ions; or (c) one or more Atmospheric Pressure Chemical ion sources for generating analyte ions or reagent ions; or (d) one or more Glow Discharge ion sources for generating analyte ions or reagent ions.

18. A method of performing Electron Transfer Dissociation or Proton Transfer Reaction reactions comprising:

providing an Electron Transfer Dissociation or Proton Transfer Reaction device comprising an ion guide comprising a plurality of electrodes each having at least one aperture, wherein ions are transmitted through the apertures; and applying one or more first transient DC voltages or potentials or one or more first transient DC voltage or potential waveforms to at least some of said plurality of electrodes in order to drive or urge at least some first ions along or through at least a portion of the axial length of said ion guide in a first direction;

wherein said first ions are caused to react with:

(i) second ions already present within said ion guide; or (ii) second ions which are subsequently added to or provided into said ion guide; and applying one or more second transient DC voltages or potentials or one or more second transient DC voltage or potential waveforms to at least some of said plurality of electrodes in order to drive or urge at least some second ions along or through at least a portion of the axial length of said ion guide in a second direction wherein said second direction is either substantially the same or substantially different to said first direction.

19. An Electron Transfer Dissociation or Proton Transfer Reaction device comprising:

an ion guide comprising a plurality of electrodes each having at least one aperture, wherein ions are transmitted through the apertures;

a source for introducing analyte cations and reagent anions into the ion guide;

a control system comprising a computer readable medium that has stored therein computer executable instructions that, when executed by the control system, causes the control system to implement the steps of:

(i) applying one or more first transient DC voltages to at least some of the plurality of electrodes to urge at least some of first cations and anions in a first direction along at least a first portion of the axial length of the ion guide; and (ii) applying one or more second transient DC voltages to at least some of said plurality of electrodes to urge at least some of second cations and anions in a second direction along at least a second portion of the axial length of said ion guide wherein said second direction is either substantially the same or substantially different to said first direction wherein at least some of the analyte cations are caused to interact with at least some reagent anions or neutral reagent gas whereupon at least some of the analyte cations dissociate to form fragment ions.

* * * * *